US007787808B2

(12) United States Patent
Aimoto

(10) Patent No.: US 7,787,808 B2
(45) Date of Patent: Aug. 31, 2010

(54) DEVELOPING DEVICE AND IMAGE FORMING APPARATUS

(75) Inventor: Toyoka Aimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 282 days.

(21) Appl. No.: 12/034,914

(22) Filed: Feb. 21, 2008

(65) Prior Publication Data

US 2008/0205943 A1 Aug. 28, 2008

(30) Foreign Application Priority Data

Feb. 22, 2007 (JP) ..... 2007-042975
Feb. 20, 2008 (JP) ..... 2008-038162

(51) Int. Cl.
*G03G 15/08* (2006.01)
*G03G 15/09* (2006.01)

(52) U.S. Cl. ..... 399/284; 399/107; 399/119; 399/252; 399/265; 399/275

(58) Field of Classification Search ..... 399/107, 399/119, 120, 222, 252, 265, 267, 274, 275, 399/284
See application file for complete search history.

(56) References Cited

U.S. PATENT DOCUMENTS 4,669,852 A * 6/1987 Tajima et al. ..... 399/282
6,337,957 B1 1/2002 Tamaki et al.

FOREIGN PATENT DOCUMENTS

| | | |
|---|---|---|
| JP | 10-319714 A | 12/1998 |
| JP | 2001-166580 A | 6/2001 |
| JP | 2005-106874 | 4/2005 |
| JP | 2005-134774 | 5/2005 |
| JP | 2006-126698 A | 5/2006 |
| JP | 2006-208579 | 8/2006 |
| JP | 2006-243112 | 9/2006 |

* cited by examiner

*Primary Examiner*—David P Porta
*Assistant Examiner*—Casey Bryant
(74) *Attorney, Agent, or Firm*—Nixon & Vanderhye, P.C.

(57) ABSTRACT

A developing device is provided having a simple configuration by which a desired amount of developer can be delivered to an image bearing member, and there is provided an image forming apparatus having the developing device. A developing device includes a developing roller by which two-component developer is borne and delivered to a photoreceptor drum, a layer thickness-regulating member for regulating a layer thickness of the developer, and a magnetism-generating member for generating magnetism, and a control unit for controlling an amount of displacement of the magnetism-generating member. The control unit 23 controls an amount of displacement of the magnetism-generating member relative to the development sleeve.

11 Claims, 15 Drawing Sheets

DEVELOPING DEVICE AND IMAGE FORMING APPARATUS

CROSS-REFERENCE TO RELATED APPLICATION

This application claims priority to Japanese Patent Application Nos. 2007-042975 and 2008-038162, which were filed on Feb. 22, 2007 and Feb. 20, 2008, the contents of which are incorporated herein by reference in its entirety.

BACKGROUND OF THE INVENTION

1. Field of the Invention

The present invention relates to a developing device which develops an electrostatic latent image with use of two-component developer, and to an image forming apparatus having the developing device.

2. Description of the Related Art

An electrophotographic image forming apparatus for forming images in the xerography process has a developing device by which an electrostatic latent image formed on a photoreceptor is developed. One example of the developing device is a developing device which uses two-component developer (that may be hereinafter referred to simply as "developer") containing a toner and a carrier in developing the electrostatic latent image. The developing device as just stated, namely a two-component developing device, develops the electrostatic latent image in a manner that the developer stored in a developer container is borne on a developer bearing member and thereby delivered to a development area facing the photoreceptor, in which area the toner contained in the developer is then supplied to the photoreceptor. In the developing device, the developer is borne on the developer bearing member with the aid of magnetic force of a magnet roller which is built in the developer bearing member.

In the two-component developing device, the toner is consumed in the image formation while the carrier is repeatedly used for a certain period of time. The carrier deteriorates under various stresses during the repeated use. The stresses include, for example, changes in an environment represented by a temperature and humidity under which the image forming apparatus is provided; heat generated by various parts in the image forming apparatus during a long-lasting operation of the image forming apparatus; and pressure caused by rapid movement of the developer into a narrow gap which is left with a layer thickness-regulating member for regulating a layer thickness of the developer. At all times, the toner is electrically attached to a surface of the carrier owing to an image force thereof. The above-mentioned stresses induce a phenomenon called spent that the toner on the surface of the carrier remains thereon and will eventually cover the surface of the carrier over time. There also appears a phenomenon that a coating material covering the surface of the carrier falls away. The developer therefore has lower flowability, resulting in a decrease in an amount of the developer which is delivered by the developer bearing member. This moreover causes a decrease in a thickness of toner layer regulated by the layer thickness-regulating member, therefore leading to a decrease in an amount of the developer which is used for developing the electrostatic latent image on the photoreceptor. As a result, an image having lower density will be formed.

The carrier and the toner are charged by friction therebetween, and charge amounts thereof are maintained by respective insulation properties inherent in both of the carrier and the toner. The charge amount of the toner is, however, influenced largely by environmental changes. For example, under a high-temperature and high-humidity condition, the charge amount of the developer becomes smaller, which causes problems such as occurrence of toner spattering and growing toner consumption.

There has been disclosed the following developing device of conventional art for solving the problems as above. In the developing device of conventional art, an electric magnet is disposed upstream of a magnetic blade as viewed in a direction where the developer is delivered, and an amount of electricity applied to the electric magnet is controlled in accordance with an atmosphere, to thereby change the magnetic force induced on the magnetic blade and thus control the thickness of the toner layer so as not to generate image defects such as uneven density and image fogging even when the atmosphere varies (refer to Japanese Unexamined Patent Publication JP-A 2005-106874, for example).

In a developing device described in Japanese Unexamined Patent Publication JP-A 2005-134774, a magnet member having at least two magnetic poles of an S-pole and an N-pole is disposed upstream of a layer thickness-regulating member as viewed in a direction where a rotary sleeve rotates so that the magnet member faces the rotary sleeve and so that one magnetic pole of the magnet member is the same as one magnetic pole of a fixed magnet roller during a developing process, whereby an amount of a toner flowing toward the layer thickness-regulating member is regulated.

During a non-developing process, the magnet member is driven to rotate in a predetermined rotational direction to thereby change a magnetic field distribution which is formed between the magnet member and the fixed magnet roller by rotation of the magnet member, so that a toner aggregate is vibrated to be dissolved. This prevents image defects which result from the toner aggregate in a gap between the rotary sleeve and the layer thickness-regulating member.

In the developing device described in JP-A 2005-106874, the electric magnet has a coil which easily catches the toner and thus causes a problem that the developer is hard to be taken out when replacing the developer. Further, the coil is constantly in contact with the developer at high pressure, which accelerates deterioration of the coil and thus requires frequent replacement of the coils. It is thus difficult to maintain the performance. Furthermore, the electric magnet is disposed so as to extend along the developer bearing member, posing such problems that the electric magnet has a larger size and a complex structure which increase in cost.

Further, in the developing device described in JP-A 2005-134774, the amount of the toner flowing toward the layer thickness-regulating member is regulated in a manner that the magnet member is disposed and made to rotate. The configuration as above has an effect of dissolving the toner aggregate, but does not focus on a property of agitating a toner newly-supplied into the developer tank, therefore causing a problem that image defects appear as the property decreases in the case of long-lasting continuous printing with high print ratio.

SUMMARY OF THE INVENTION

An object of the invention is to provide a developing device having a simple configuration by which a desired amount of developer can be delivered to an image bearing member, and to provide an image forming apparatus having the developing device.

The invention provides a developing device which develops an electrostatic latent image formed on an image bearing member, with use of two-component developer, the developing device comprising:

a developer bearing member capable of rotating around a predetermined first axis line, the developer bearing member having a development sleeve by which the two-component developer is borne and delivered to the image bearing member, and a magnet roller for generating magnetism provided in the development sleeve;

a layer thickness-regulating member for regulating a layer thickness of the two-component developer borne on the development sleeve, the layer thickness-regulating member facing the development sleeve;

a magnetism-generating member for generating magnetism, which is disposed upstream of the layer thickness-regulating member in a direction where the development sleeve rotates, the magnetism-generating member facing the development sleeve and being displaceable; and a control unit for controlling an amount of displacement of the magnetism-generating member relative to the development sleeve.

According to the invention, the developing device includes: the developer bearing member by which the two-component developer (which may be hereinafter referred to simply as "developer") is borne and delivered to the image bearing member; the layer thickness-regulating member for regulating the layer thickness of the developer; the magnetism-generating member for generating the magnetism; and the control unit for controlling the amount of displacement of the magnetism-generating member relative to the development sleeve. The developer bearing member can rotate around the first axis line, and has the development sleeve and the magnet roller for generates magnetism, which roller is provided in the development sleeve. The magnet roller enables the development sleeve to bear on the surface thereof the developer and thereby deliver the developer to the image bearing member. The magnetism-generating member is disposed to be upstream of the layer thickness-regulating member in the direction where the development sleeve rotates and to be displaced so as to face the development sleeve. The magnetism-generating member generates the magnetism which allows for the control of the layer thickness of the developer borne by the development sleeve. The control unit controls the amount of displacement of the magnetism-generating member relative to the development sleeve. The control on the amount of displacement allows for the control on the influences of the magnetism which the magnetism-generating member generates toward the development sleeve. It is therefore possible to control an amount of developer which passes through a gap between the magnetism-generating member and the development sleeve. The layer thickness of the developer can be thus regulated to a desired thickness without fail by the layer thickness-regulating member which is located downstream of the magnetism-generating member in its rotating direction. This makes it possible to control also a travel amount of the developer to the image bearing member. There can be thus realized the developing device having a simple configuration by which a desired amount of the developer can be delivered to the image bearing member. Moreover, by horizontally moving the magnetism-generating member rotating, the amount of the developer moving by the development sleeve and the position where the developer and the supply toner collide with each other, can be precisely adjusted and controlled depending on properties and usage environment of the developer, therefore achieving the optimum property of agitating the developer.

Further, in the invention, it is preferable that the magnetism-generating member is capable of being displaced at least horizontally, and the control unit controls an amount of horizontal displacement of the magnetism-generating member.

According to the invention, the magnetism-generating member is adapted to be displaceable at least in the horizontal direction, and the amount of horizontal displacement thereof is controlled by the control unit.

A distance between the magnetism-generating member and a predetermined magnetic pole of the magnet roller and respective surface magnetic force of the magnetism-generating member and the predetermined magnetic pole are appropriately adjusted, whereby an amount of the developer moving from the surface of the development sleeve to an area above the agitating member can be adjusted with the aid of repulsive magnetic force which is generated between a magnetic pole of the magnetism-generating member and a magnetic pole of the magnet roller.

A toner to be newly supplied into the developer container is set to fall down from the area above the agitating member, with the result that the developer moved from the development sleeve and the falling toner for replenishment collide with each other at a substantially one position, and the toner for replenishment is then mixed with the developer and agitated by the agitating member.

The controllability of the magnetic force changes according to how to displace the magnetism-generating member. In particular, when the magnetism-generating member is displaced horizontally to change the distance between the magnetism-generating member and the development sleeve, the controllability is enhanced, therefore allowing for precise control.

Further, in the invention, it is preferable that the magnetism-generating member comprises:

a cylindrical body having a cylindrical shape which is capable of being angularly displaced around a predetermined second axis line; and a magnetic pole-forming portion for forming magnetic poles at a plurality of positions in a circumferential direction of the cylindrical body, which magnetic pole-forming portion is located inside the cylindrical body, and the control unit controls an amount of angular displacement of the cylindrical body around the second axis line.

According to the invention, the magnetism-generating member includes the cylindrical body which is disposed so as to be angularly displaceable around the second axis line, and the magnetic pole-forming portion which is disposed inside the cylindrical body and forms the magnetic poles at the plurality of positions in the circumferential direction of the cylindrical body. The control unit controls the amount of angular displacement of the cylindrical body around the second axis line. By controlling the amount of angular displacement, the control unit can effect that, of the plurality of magnetic poles, a part which radiates the most suitable magnetism is brought to face the development sleeve. The magnetic force between the developer bearing member and the layer thickness-regulating member can be thus controlled. In addition, since the magnetic pole-forming portion is disposed inside the cylindrical body, the developer can be prevented from being undesirably attached to the magnetic pole-forming portion. There is therefore no risk of, for example, blocking of the developer in the magnetism-generating member. As a result, a stable development performance can be exhibited even when the number of developments increases.

Further, in the invention, it is preferable that a length of the magnetism-generating member is equal to a length of the developer bearing member as viewed in a direction where the first axis line extends.

According to the invention, the length of the magnetism-generating member is equal to the length of the developer bearing member as viewed in the direction that the first axis line extends. This makes it possible to control the amount of the developer which passes through the gap between the magnetism-generating member and the development sleeve, over an entire area of development region on the developer bearing member. A difference from place to place in the amount of the developer borne on the developer bearing member can be therefore eliminated over the entire area of the developer bearing member. As a result, the development without variations can be achieved.

Further, in the invention, it is preferable that a length of the magnetism-generating member is longer than a length of the developer bearing member as viewed in a direction where the first axis line extends.

According to the invention, the length of the magnetism-generating member is longer than the length of the developer bearing member as viewed in the direction where the first axis line extends. The property of the magnetism-generating member to generate the magnetism may cause both end portions of the magnetism-generating member to have lowered abilities to control a travel amount of the developer compared with the ability exhibited by a middle part of the magnetism-generating member. The amount of the developer may be therefore different from the end portion to the middle part in the development region if the length of the magnetism-generating member is equal to the length of the developer bearing member. In order to deal with the problem, the length of the magnetism-generating member is set to be longer than the length of the developer bearing member in the invention so that the amounts of the developer can be equalized between the end portion and the middle part in the development area. A difference from place to place in the amount of the developer borne on the developer bearing member can be therefore eliminated over the entire area of the developer bearing member. As a result, the development without variations can be achieved.

Further, in the invention, it is preferable that the control unit controls the amount of displacement of the magnetism-generating member based on toner density detected by a density detecting section for detecting density of a toner in an image developed on the image bearing member.

According to the invention, the control unit controls the amount of displacement of the magnetism-generating member based on the toner density detected by the density detecting section for detecting density of the toner in the image developed on the image bearing member. An amount of the developer to be delivered can be therefore controlled based on the toner density detected in real time according to environmental changes and deterioration of the developer. As a result, the amount of the developer to be delivered can be controlled so as to be the most appropriate.

Further, in the invention, it is preferable that surface roughness of the magnetism-generating member is different from surface roughness of the development sleeve.

According to the invention, the surface roughness of the magnetism-generating member is different from the surface roughness of the development sleeve. By setting the surface roughness of the magnetism-generating member to be different from the surface roughness of the development sleeve as mentioned above, an amount of moving developer borne on a surface of the magnetism-generating member can be made different from an amount of moving developer borne on a surface of the development sleeve. Therefore, for example, when the surface of the development sleeve is rougher than the surface of the magnetism-generating member, a larger amount of the developer can be delivered to the development sleeve, so that the development sleeve can be set to exhibit higher ability to deliver the developer as compared to the magnetism-generating member. In this way, the amount of the developer delivered by the developer carrying member can be set at a desired amount.

Further, in the invention, it is preferable that a diameter of the cylindrical body is smaller than a diameter of the development sleeve.

According to the invention, the diameter of the cylindrical body is smaller than the diameter of the development sleeve. This makes it possible to downsize the whole developing device.

Further, in the invention, it is preferable that a diameter of the cylindrical body is equal to a diameter of the development sleeve.

According to the invention, the diameter of the cylindrical body is equal to the diameter of the development sleeve. The cylindrical body and the development sleeve can be therefore made in common, allowing for a decrease in cost.

Further, in the invention, it is preferable that magnetic force of the magnet roller in the development sleeve which force is positioned opposite to the magnetism-generating member, is set to be larger than magnetic force of the magnetism-generating member which force is positioned opposite to the development sleeve.

According to the invention, the magnetic force of the magnet roller in the development sleeve at the position where the magnet roller faces the magnetism-generating member, is set to be larger than the magnetic force of the magnetism-generating member at a position where the magnetism-generating member faces the development sleeve. The developer borne on the developer bearing member can be therefore prevented from being undesirably borne on the magnetism-generating member. In this way, the amount of the developer borne by the developer bearing member can be prevented from being too small, with the result that the developer can be reliably delivered to the image bearing member.

The invention provides an image forming apparatus comprising the developing device mentioned above.

According to the invention, the image forming apparatus has the developing device, thus allowing for the image forming apparatus which achieves the excellent effects described above.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
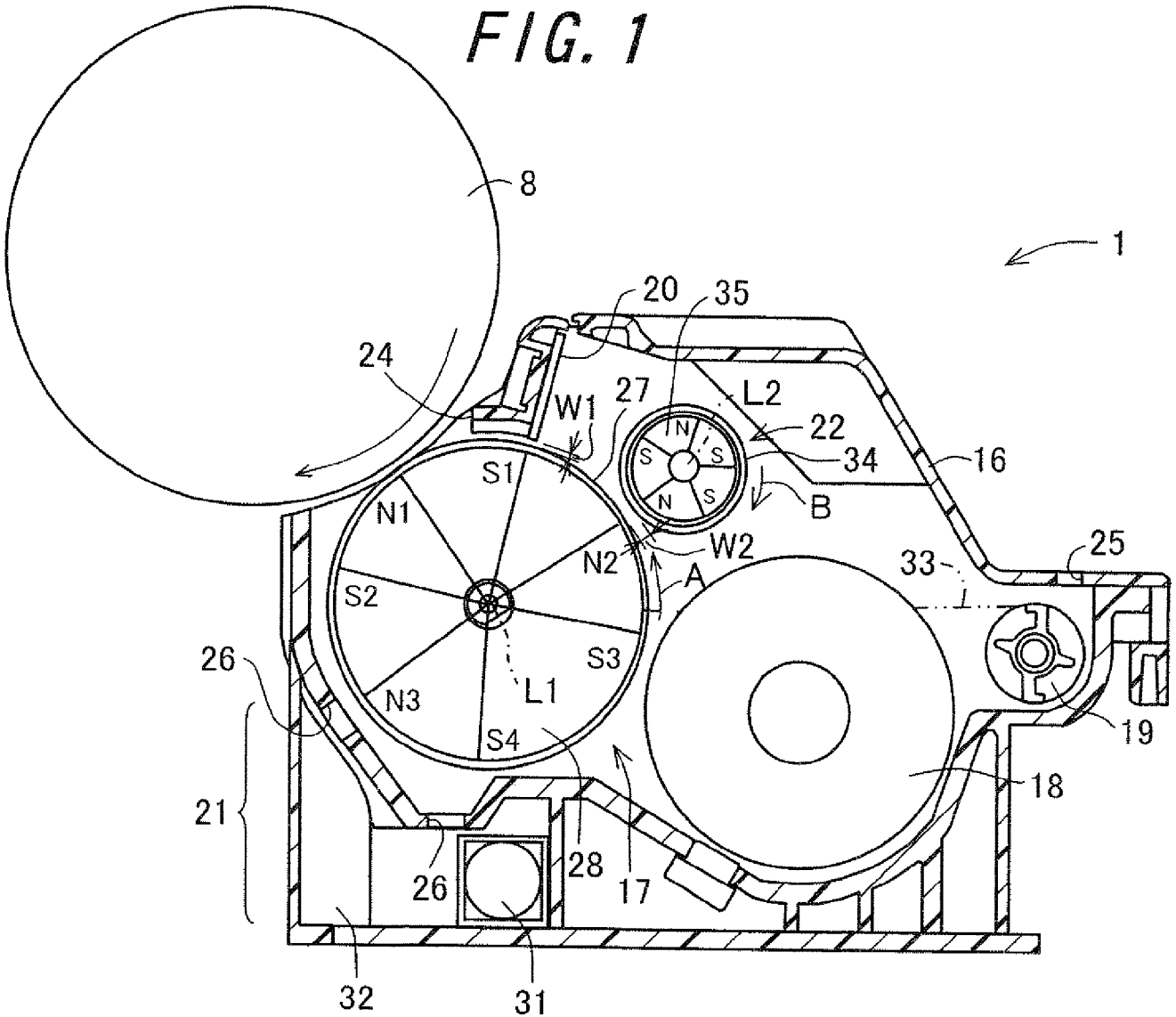
FIG. 1 is a front view schematically showing a developing device according to a first embodiment of the invention.

Now referring to the drawings, preferred embodiments of the invention are described below.

A plurality of embodiments for implementing the invention will be hereinbelow described with reference to the drawings. In respective embodiments, parts corresponding to parts already explained in any of the preceding embodiments will be denoted by the same reference symbols, and overlapping descriptions thereof may be omitted. In the case where only a part of the configuration is described, the other parts of the configuration are the same as those already described in the preceding embodiments. Not only is it possible to combine parts specifically described in the respective embodiments, but the embodiments can also be combined with each other unless any troubles are caused particularly in the combination.

Figure 2:
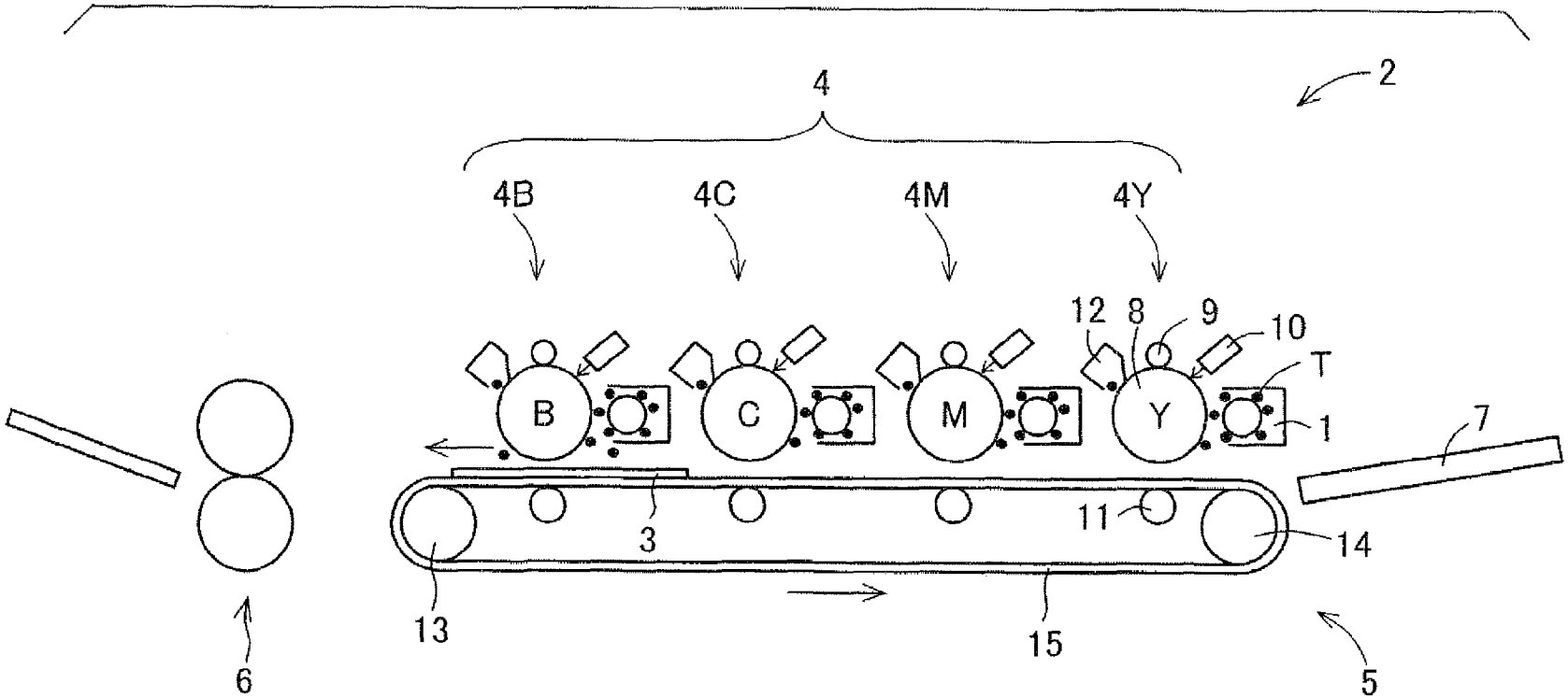
FIG. 2 is a front view schematically showing one example of an image forming apparatus where the developing device shown in FIG. 1 is employed.

FIG. 1 is a front view schematically showing a developing device 1 according to a first embodiment of the invention. FIG. 2 is a front view schematically showing an image forming apparatus 2 that is one example where the developing device 1 is employed. The image forming apparatus 2 according to the present embodiment is achieved by a color image forming apparatus of dry electrophotographic system. The image forming apparatus 2 is adapted to form a multicolor or unicolor image on a predetermined recording sheet 3 based on image data etc. sent from various terminals on a network, for example. The image forming apparatus 2 has four visualized image forming units 4Y, 4M, 4C and 4B (which may be hereinafter referred to collectively as "visualized image forming unit 4"), a recording sheet-conveying section 5, a fixing device 6, and a supply tray 7.

On the supply tray 7, a plurality of recording sheets 3 can be placed. The plurality of recording sheets 3 placed on the supply tray 7 are fed sheet by sheet to the visualized image forming unit 4Y which is located the closest to the supply tray 7.

The visualized image forming units 4 correspond to yellow (Y), magenta (M), cyan (C), and black (B), respectively. The four visualized image forming units 4Y, 4M, 4C and 4B are thus arranged. The visualized image forming unit 4Y forms images with use of a toner T of yellow (Y); the visualized image forming unit 4M forms images with use of a toner T of magenta (M); the visualized image forming unit 4C forms images with use of a toner T of cyan (C); and the visualized image forming unit 4B forms images with use of a toner T of black (B). A specific layout is a so-called tandem type that the four visualized image forming units 4 are arranged along a conveyance path of the recording sheet 3 which conveyance path connects the supply tray 7 for the recording sheet 3 with the fixing device 6.

The visualized image forming units 4 have substantially the same configurations, each of which includes the developing device 1, a photoreceptor drum 8, a charger 9, a laser beam-emitting portion 10, a transfer roller 11, and a cleaning unit 12. Through the visualized image forming units 4, the toners T of respective colors are transferred onto the recording sheet 3 conveyed from the supply tray 7, so that the toners T are combined on the recording sheet 3.

The photoreceptor drum 8 bears an image formed thereon. The charger 9 uniformly charges a surface of the photoreceptor drum 8 so that the surface of the photoreceptor drum 8 has a predetermined potential. In accordance with image data inputted to the image forming apparatus 2, the laser beam-emitting portion 10 exposes the surface of photoreceptor 8 charged by the charger 9 so that an electrostatic latent image is formed on the surface of the photoreceptor drum 8. Using the developing device 1, the electrostatic latent image formed on the surface of the photoreceptor drum 8 is visualized with use of the toners T of respective colors. To the transfer roller 11 has been applied a bias voltage whose polarity is opposite to that of the toner T. With the assistance of the transfer roller 11, a toner image visualized on the surface of the photoreceptor 8 is transferred onto the recording sheet 3 conveyed by the later-described recording sheet-conveying section 5. The drum cleaner unit 12 removes and collects the toners T which remain on the surface of the photoreceptor drum 8 after the developing process in the developing device 1 and after the image formed on the photoreceptor drum 8 has been transferred. The transferring operation of the toner image onto the recording sheets 3 as described above is repeated four times for four colors.

The recording sheet-conveying section 5 has a driving roller 13, an idling roller 14, and a conveying belt 15. In the recording sheet-conveying section 5, the recording sheet 3 fed from the supply tray 7 is conveyed so that the toner image is formed on the recording sheet 3 by the visualized image forming units 4. Over the driving roller 13 and the idling roller 14 is stretched the conveying belt 15 which is endless. The driving roller 13 is so controlled as to rotate at a predetermined circumferential velocity, thereby rotating the endless conveying belt 15. On an outer surface of the conveying belt 15, static electricity is generated to electrostatically attract the recording sheet 3, whereby the recording sheet 3 is conveyed by the conveying belt 15.

As above, the toner image is transferred onto the recording sheet 3 being conveyed by the conveying belt 15. The recording sheet 3 is then detached from the conveying belt 15 attributable to a curvature of the driving roller 13, thereafter being conveyed to the fixing device 6. In the fixing device 6, adequate heat and pressure are given to the recording sheet 3 so that the toners T are molten and thereby fixed to the recording sheet 3, with the result that a solid image is formed.

Next, the configuration of the developing device 1 will be described with reference to FIG. 1. The developing device L includes a developer container 16, a developing roller 17, a paddle 18, an agitating roller 19, a layer thickness-regulating member 20, an exhaust portion 21, a magnetism-generating member 22, and a control unit 23 (refer to FIG. 5). The developer container 16 is a container-shaped member which is made of synthetic resin, for example. In an internal space of the developer container 16, the developing roller 17, the paddle 18, the agitating roller 19, and the layer thickness-regulating member 20 are provided. Furthermore, the two-component developer (which may be hereinafter referred to simply as "developer") containing the toner T and the carrier is stored in the internal space of the developer container 16. An opening 24 is formed in a side surface of developer container 16 which faces the photoreceptor drum B. The opening 24 extends in parallel with an axial line of the photoreceptor drum 8. Further, a developer inlet 25 is formed in a wall of developer container 16 above the agitating roller 19 as viewed in a vertical direction. Above the developer inlet 25 as viewed in the vertical direction, a developer hopper (not shown) is disposed.

The developer hopper is disposed so that the developer inlet 25 is connected in contact with a toner supply port (not shown) which is formed in a lower part of the developer hopper as viewed in the vertical direction. The internal space of the developer container 16 is thus communicated with an internal space of the developer hopper. The developer hopper is a container-shaped member which is made of synthetic resin, for example. In the internal space of the developer hopper, the toner T is stored. The toner T stored in the developer hopper is supplied into the developer container 16 through the developer inlet 25 in accordance with the consumption situation of the toner T in the developer container 16. Moreover, an exhaust vent 26 is formed in a wall of the developer container 16 below the developing roller 17 as viewed in the vertical direction. Functions of the exhaust vent 26 will be described later.

The agitating roller 19 agitates the toner T which is supplied from the developer hopper to the developer container 16 in accordance with the consumption situation of the toner T, thereby uniformly delivering the toner T to a circumference of the paddle 18. The agitating roller 19 is disposed so as to face the developing roller 17 with the paddle 18 therebetween. The agitating roller 19 is a screw-shaped roller member, for example, which is rotatably supported by the developer container 16.

The paddle 18 agitates and thus delivers the developer delivered from the agitating roller 19, thereby supplying the developer to the developing roller 17. The paddle 18 is disposed so as to face the photoreceptor drum 8 with the developing roller 17 therebetween. The paddle 18 is a roller member, for example, which is supported by the developer container 16 so as to be rotatable around a shaft of the roller member. Rotation of the paddle 18 causes the developer in the developer container 16 to be supplied to a circumference of the developing roller 17, whereby a developer layer is formed on a surface of the developing roller 17.

The developing roller 17 is a developer bearing member. The developing roller 17 is disposed so as to be rotatable about the predetermined first axis line L1, and includes a development sleeve 27 and a magnet roller 28. The development sleeve 27 bears the two-component developer and thus delivers the two-component developer to the photoreceptor drum 8. The magnet roller 28 is provided inside the development sleeve 27 and generates magnetism. The developing roller 17 is a roller member, for example, which is disposed at a distance from the photoreceptor drum 8 through the opening 24 that is formed in the developer container 16 and faces the photoreceptor drum 8, and which is disposed so that an axis line of the photoreceptor drum 8 and the first axis line L1 are parallel to each other. The development sleeve 27 is a cylindrical member which rotatably covers the magnet roller 28. In the present embodiment, the development sleeve 27 is a circular cylindrical member. The development sleeve 27 is made of, for example, a metal such as aluminum or stainless steel. To the development sleeve 27, a potential is applied by a power source (not shown) so that a difference is generated in potential between the development sleeve 27 and the photoreceptor drum 8.

The magnet roller 28 is fixed inside the development sleeve 27 so as to be enclosed thereby. The magnet roller 28 forms magnetic poles inside the development sleeve 27. The magnet roller 28 is composed of magnet members having different magnet poles, which are arranged in a circumferential direction in a substantially alternate manner. In the embodiment, the magnet roller 28 is formed of a permanent magnet such as ferrite, and has seven magnet poles S1, N1, S2, N3, S4, S3 and N2.

One end portion in an axis direction of the development sleeve 27 is rotated by a drive mechanism 29 (refer to FIG. 3) in a counterclockwise direction on a drawing sheet of FIG. 1, that is, in an arrow A direction. The other end portion in the axis direction of the development sleeve 27 is supported by a sliding bearing 30, for example. In a development region (development nip area) where a distance is the shortest between the development sleeve 27 and the photoreceptor drum 8, the development sleeve 27 rotates in a direction where the photoreceptor drum 8 rotates. That is to say, a rotational direction of the development sleeve 27 around the axis line L1 is opposite to a rotational direction of the photoreceptor drum 8 around an axis line thereof. For more simplified explanations, the rotational direction of the development sleeve 27 will be sometimes referred to as a rotational direction of the developing roller 17 in the following descriptions. The developing roller 17 magnetically attracts the carrier thereto with the aid of the magnetic force of magnetic poles formed in the magnet roller 28 so that a magnetic brush of the carrier and toner T is formed on an outer circumferential surface, i.e., a surface positioned on an outer side as viewed in a radial direction, of the development sleeve 27. The magnetic brush is formed along magnetic fields radiated by the magnetic poles formed in the magnet roller 28. The development sleeve 27 is made to rotate in the arrow A direction, and the developing roller 17 thereby delivers the developer to the development nip area where the developing roller 17 and the photoreceptor drum 18 face each other at the shortest distance. The toner T in the magnetic brush is thus supplied to the surface of the photoreceptor drum 8.

The layer thickness-regulating member 20 is disposed so as to face the development sleeve 27, and regulates the layer thickness of the developer borne on the development sleeve 27. Using the layer thickness-regulating member 20 as just described, the layer thickness of the developer is adjusted to a desired value. The layer thickness-regulating member 20 is a thin plate member having one end portion being mounted on the developer container 16 and the other end portion being a free end portion as viewed in a transverse direction of the layer thickness-regulating member 20. The thin plate member is disposed so as to be distanced away from the surface of the developing roller 17 with a gap therebetween and come into contact with the developer layer borne on the surface of the developing roller 17. The gap mentioned above is referred to as a distance W1. The distance W1 between the layer thickness-regulating member 20 and the developing roller 17 is the shortest distance between the developing roller 17 and the layer thickness-regulating member 20 as viewed in the radial direction of the developing roller 17. The distance W1 is, for example, 0.5 mm or more and 1.0 mm or less. The layer thickness-regulating member 20 may be a thin plate which is made of a nonmagnetic elastic material, for example. A material to be selected as the elastic material is not particularly limited, and may be a metal having elasticity, such as aluminum or stainless steel represented by SUS316, synthetic resin having elasticity, or the like material. Moreover, in order to improve the image quality furthermore, magnetic stainless steel represented by SUS430 may also be used for the layer thickness-regulating member 20. A predetermined amount of the developer which has passed through the gap between the layer thickness-regulating member 20 and the developing roller 17, is then delivered to the development nip area by rotation of the developing roller 17.

The exhaust portion 21 vacuums up the air inside the developer container 16 and evacuates the air to outside. The exhaust portion 21 includes the exhaust vents 26, an exhaust fan 31, and an exhaust duct 32. The exhaust fan 31 is positioned so as to face the developing roller 17 across the wall of the developer container 16 as viewed in the vertical direction. The exhaust fan 31 vacuums up the air inside the developer container 16 and evacuates the air to outside through the exhaust vents 26 and the exhaust duct 32. This reduces pressure inside the developer container 16 to negative pressure so that fresh air can be introduced into the developer container 16 through the opening 24. Each of the exhaust vents 26 is a strip-shaped opening which is formed on the wall of the developer container 16 below the developing roller 17 as viewed in the vertical direction and which extends in parallel with the axis line L1 of the developing roller 17 and extends in a longitudinal direction of the developer container 16. The exhaust vents 26 are formed in parallel with each other. The exhaust vent 26 is a passage through which the fresh air introduced into the developer container 16 through the opening 24 is discharged to outside of the developer container 16. The exhaust duct 32 is disposed outside of the developer container 16 and close to the exhaust vents 26. In the exhaust duct 32, the air discharged from the exhaust vents 26 is temporarily stored. In the exhaust portion 21, the air flowing from the gap between the photoreceptor drum 8 and the developer container 16 into the developer container 16 through the opening 24 flows around the developing roller 17 and passes through the exhaust vents 26 to enter the exhaust duct 32, thereafter being evacuated by the exhaust fan 31 to outside of the developer container 16. The air which flows through a flow passage of air in the developer container 16, is subjected to a dust removing process through a filter (not shown) provided in the flow passage, and thus may be evacuated to outside of the developer container 16 without any other treatments.

Figure 3:
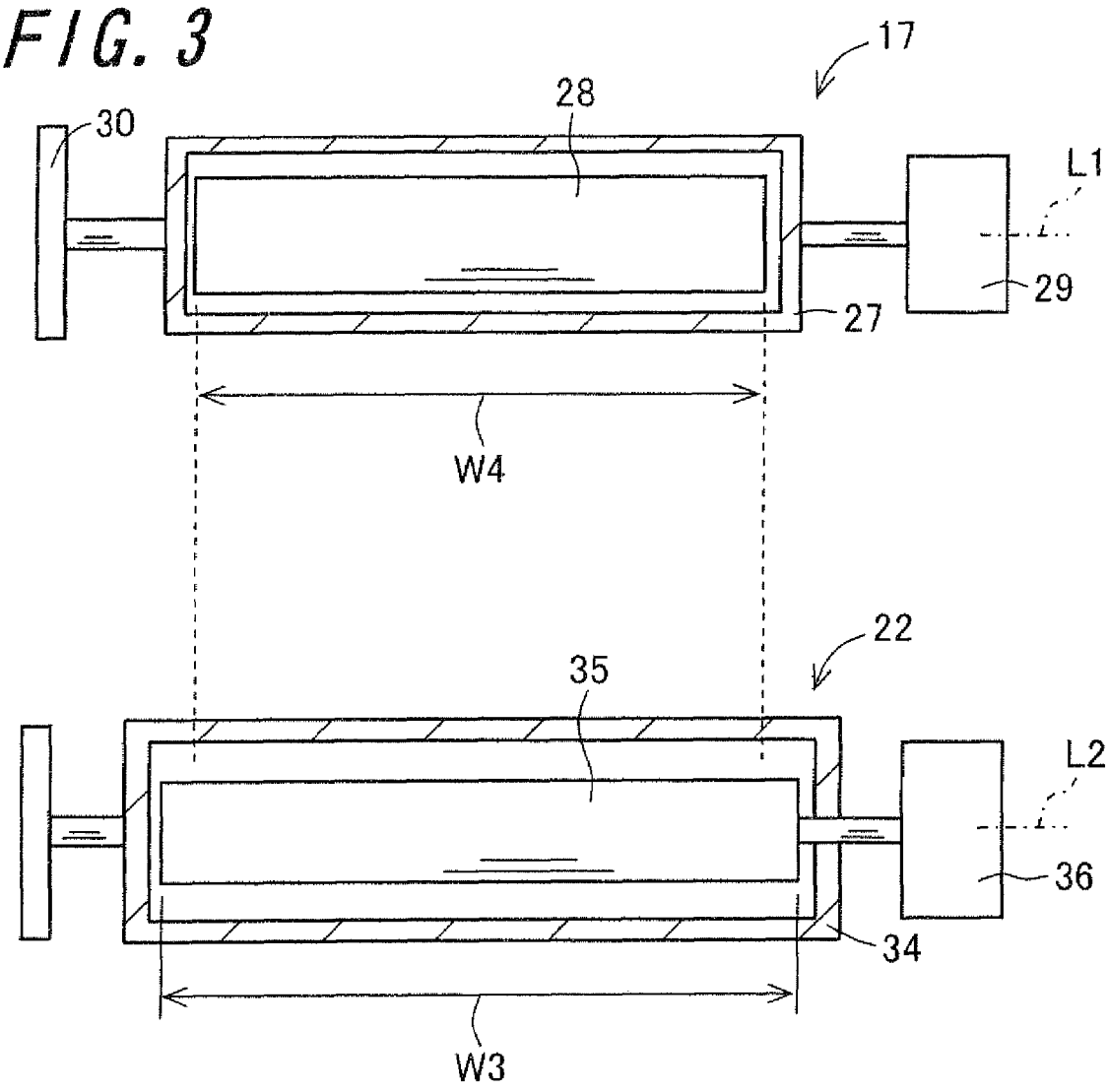
FIG. 3 is a sectional view schematically showing a magnetism-generating member and a developing roller.

FIG. 3 is a sectional view schematically showing the magnetism-generating member 22 and the developing roller 17. With reference to FIG. 3 as well as FIG. 1, the magnetism-generating member 22 will be explained. In FIG. 3, the magnetism-generating member 22 and the developing roller 17 are depicted with a distance therebetween so that the configuration can be understood more easily. The magnetism-generating member 22 is disposed upstream of the Layer thickness-generating member 20 as viewed in a direction where the development sleeve 27 rotates, and disposed so as to be displaceable relative to the development sleeve 27. The magnetism-generating member 22 is disposed above a developer level 33 as viewed in the vertical direction, and positioned close to the paddle 18. The magnetism-generating member 22 can be angularly displaced around a predetermined second axis line L2. The magnetism-generating member 22 has a cylindrical body 34 and a magnetic pole-forming portion 35. The cylindrical body 34 has a cylindrical shape. The magnetic pole-forming portion 35 is disposed inside the cylindrical body 34 and forms magnetic poles at a plurality of positions in a circumferential direction of the cylindrical body 34.

In the present embodiment, the cylindrical body 34 is formed into a circular cylindrical shape, for example. The shape of the cylindrical body 34 is not limited to the circular cylindrical shape and may be a polygonal shape. The cylindrical body 34 is distanced away from the development sleeve 27 with a gap therebetween, and disposed so that the axis line L1 of the development sleeve 27 and the axis line L2 of the cylindrical body 34 are parallel to each other. The gap mentioned above is referred to as a distance W2. The distance W2 is the shortest distance between an outer circumferential surface of the cylindrical body 34 and an outer circumferential surface of the development sleeve 27, and selected based on the layer thickness of the developer borne on the development sleeve 27, the magnetic force of the magnetism-generating member 22, and the like element. The distance W2 is set at 5 mm or more and 10 mm or less, for example. The cylindrical body 34 rotatably covers the magnetic pole-forming portion 35. The cylindrical body 34 is made of, for example, a metal such as aluminum or stainless steel. A diameter of the cylindrical body 34 is set to be equal to or smaller than a diameter of the development sleeve 27. In the embodiment, the diameter of the cylindrical body 34 is set to be smaller than the diameter of the development sleeve 27. For example, the diameter of the cylindrical body 34 is set at 10 mm and the diameter of the development sleeve 27 is set at 30 mm. When the diameter of the cylindrical body 34 is set to be smaller than the diameter of the development sleeve 27, the whole developing device 1 can be made smaller.

The magnetic pole-forming portion 35 is enclosed by the cylindrical body 34 and can be angularly displaced about the axis line of the cylindrical body 34. The magnetic pole-forming portion 35 forms magnetic poles inside the cylindrical body 34. The magnetic pole-forming portion 35 is composed of magnet members having different magnet poles, which are arranged in a circumferential direction in a substantially alternate manner. In the embodiment, the magnetic pole-forming portion 35 is formed of a permanent magnet such as ferrite, AlCoNi, and rare earths, and composed of two N-pole magnet parts and three S-pole magnet parts. As shown in FIG. 1, the N-pole magnet part is located at a position on a line segment between a rotation center of the development sleeve 27 and a rotation center of the cylindrical body 34. Among the five magnet parts of the magnetic pole-forming portion 35, at least one magnet part is set to have magnetic force that is smaller than the magnetic force of magnet roller 28 at a position where the magnet roller 28 faces the magnetism-generating member 22. Consequently, by the angular displacement of the magnetic pole-forming portion 35, the magnetic force of magnet roller 28 at a position where the magnet roller 28 faces the magnetism-generating member 22, can be set to be larger than the magnetic force of magnetic pole-forming portion 35 at a position where the magnetic pole-forming portion 35 faces the development sleeve 27. With the aid of a magnetic pole-forming portion-drive mechanism 36, one end portion of the magnetic pole-forming portion 35 as viewed in a direction of axis line thereof can be angularly displaced as much as desired. The magnetic pole-forming portion-drive mechanism 36 is a stepping motor, for example.

The cylindrical body 34 is rotated by the drive mechanism 29, for example, in a clockwise direction on a drawing sheet of FIG. 1, that is, in an arrow B direction. Such a rotational direction of the cylindrical body 34 may be either of a clockwise direction or a counterclockwise direction. The rotational direction of the cylindrical body 34 is appropriately determined depending on a comprehensive balance of surface profiles, magnetic force, distances, etc. of the development sleeve 27 and the cylindrical body 34. Further, the cylindrical body 34 is mechanically coupled with the drive mechanism 29 using a gear therebetween, thus being able to receive drive force. In the configuration as just stated, the development sleeve 27 and the cylindrical body 34 can be driven by one drive mechanism 29, allowing for simplification of the configuration.

Further, in the embodiment, as shown in FIG. 3, sizes of the magnetism-generating member 22 and the developing roller 17 are set such that a length W3 of the magnetism-generating member 22 is larger than a length W4 of the developing roller 17 as viewed in the direction where the first axis line L1 extends.

Figure 4B:
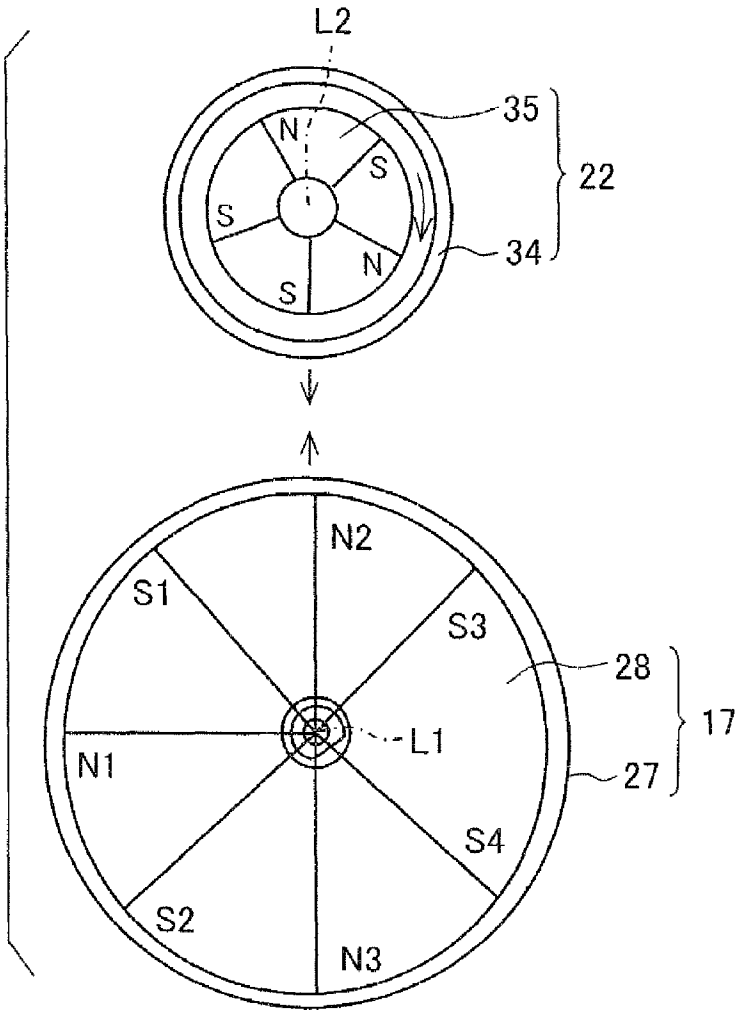
FIGS. 4A and 4B are front views, each for assisting explanation of relation between the developing roller and the magnetism-generating member.
Figure 4A:
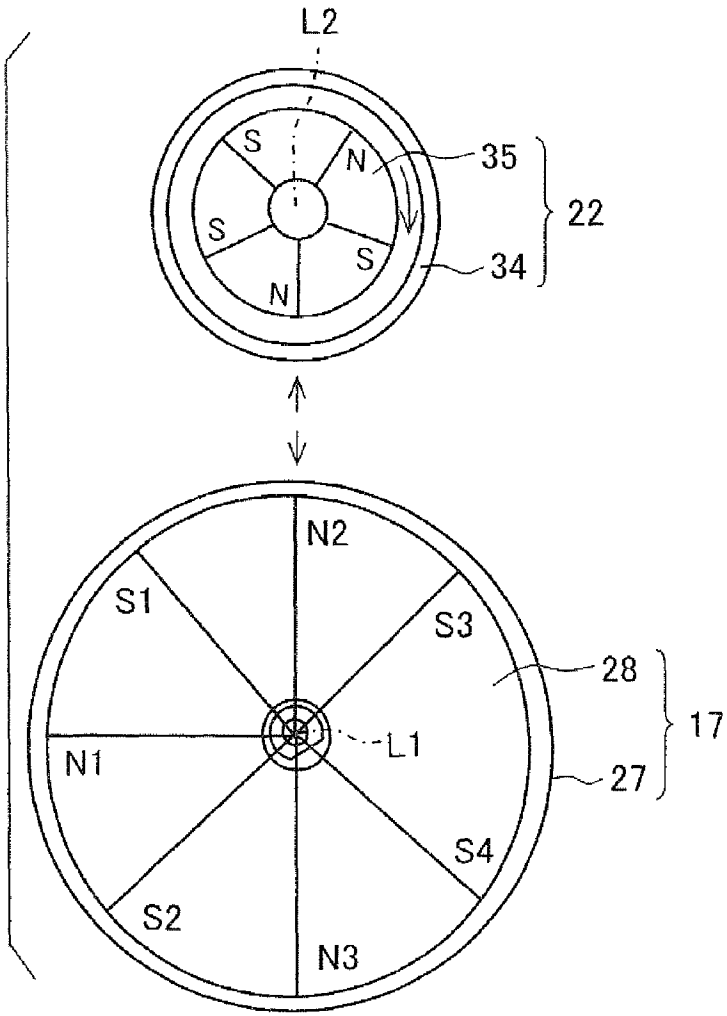

FIGS. 4A and 4B are front views, each for assisting explanation of relation between the developing roller 17 and the magnetism-generating member 22. An amount of the developer which is borne by the development sleeve 27 and thereby passes through a gap between the development sleeve 27 and the cylindrical body 34, is associated with a distribution of magnetic force formed by the magnet roller 28 and the magnetic pole-forming portion 35. For example, in the case where, as shown in FIG. 4A, the N-pole magnet part of the magnet roller 28 faces the N-pole magnet part of the magnetic pole-forming portion 35 at a distance which is the shortest between the developing roller 17 and the magnetic pole-forming portion 35, the both of the magnet parts repel each other, resulting in low density of magnetic flux between the magnetic pole-forming portion 35 and the magnet roller 28. In this case, the ability to deliver the developer is low, resulting in a decrease in the amount of the developer which passes through the gap between the development sleeve 27 and the cylindrical body 34.

The magnetic pole-forming portion 35 shown in FIG. 4A is angularly displaced about the axis line L2 into the state shown in FIG. 4B. In the case as shown in FIG. 4B where the N-pole magnet part of the magnet roller 28 faces the S-pole magnet part of the magnetic pole-forming portion 35 at a distance which is the shortest between the developing roller 17 and the magnetic pole-forming portion 35, the both of the magnet parts are pulled together, resulting in high density of magnetic flux between the magnetic pole-forming portion 35 and the magnet roller 28. In this case, the ability to deliver the developer is high, resulting in an increase in the amount of the developer which passes through the gap between the development sleeve 27 and the cylindrical body 34. Accordingly, the control on the amount of angular displacement of the magnetic pole-forming portion 35 allows for the control on the ability of the developing roller 17 to deliver the developer.

The density of magnetic flux between the magnetic pole-forming portion 35 and the magnet roller 28 is influenced also by density levels of magnetic flux of the magnetic pole-forming portion 35 itself and the magnet roller 28 itself. When the magnetic force between the magnet roller 28 and the magnetic pole-forming portion 35 is large and the ability to deliver the developer is high, pressure on the developer is high and a charge amount of the developer is therefore high. Accordingly, the magnetism-generating member 22 has also a function of controlling the charge amount of the developer.

Figure 5:
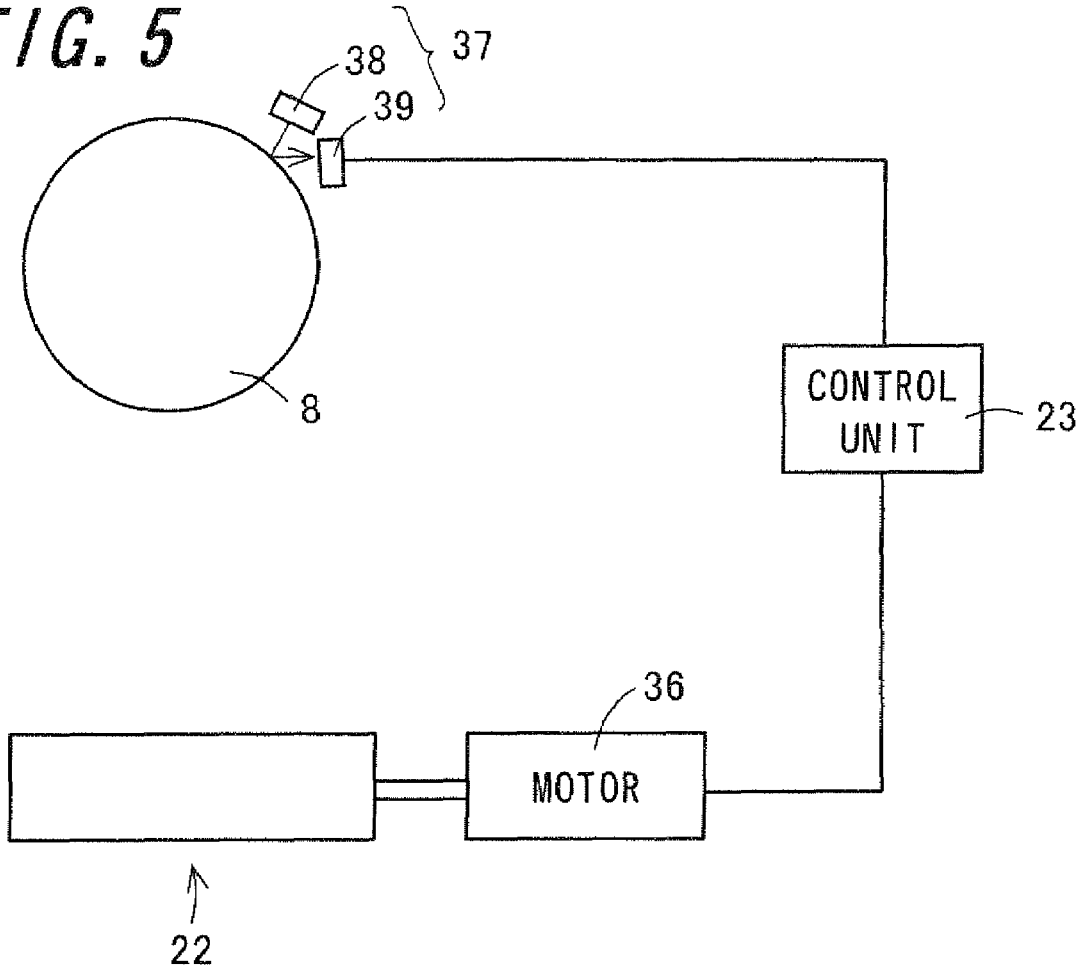
FIG. 5 is a block diagram schematically showing an electric configuration relating to the magnetism-generating member.

FIG. 5 is a block diagram schematically showing an electric configuration relating to the magnetism-generating member 22. The control unit 23 controls the distance between the magnetism-generating member 22 and the development sleeve 27. In the embodiment, the control unit 23 controls the amount of angular displacement about the axis line L2 of the cylindrical body 34. The control unit 23 controls the amount of angular displacement of the magnetism-generating member 22 based on toner density detected by a density detecting section 37 for detecting density of a toner in an image developed on the photoreceptor drum 8. The magnetic force generated between the magnetism-generating member 22 and the developing roller 17 is thus controlled in accordance with measurements of patches on the photoreceptor drum 8, whereby the amount of the toner to be delivered to the layer thickness-regulating member 20 is controlled so as to reduce the changes in the development resulting from the changes in an ambient environment indicated by temperature and humidity, the degradation of the developer, and the like element.

The density detecting section 37 includes a light-emitting element 38 and a light-receiving element 39. The light-emitting element 38 irradiates, for example, the photoreceptor drum 8 with infrared light. The light-receiving element 39 receives infrared light reflected by the photoreceptor drum 8. Accordingly, the light emitted from the light-emitting element 38 is reflected by the toner image on the photoreceptor drum 8 and detected by the light-receiving element 39. In accordance with a value obtained by detection of the light through the light-receiving element 39, the control unit 23 gives a drive command to the magnetic pole-forming portion-drive mechanism 36. The magnetic pole-forming portion-drive mechanism 36 then displaces the magnetic pole-forming portion 35 about an axis line thereof by a few degrees to 180 degrees, for example.

In the developing device 1 using the two-component developer, the toner T is consumed in the image formation while the carrier is repeatedly used for a certain period of time. The carrier deteriorates under various stresses during the repeated use. When the developer deteriorates as just mentioned, the developer has lower fluidity and lower chargeability, resulting in lower density of the toner on the photoreceptor drum 8. When the toner density is decreased, the control unit 23 gives the drive command to the magnetic pole-forming portion-drive mechanism 36 to thereby control the amount of angular displacement of the magnetic pole-forming portion 35 so as to increase the density of magnetic flux between the magnetic pole-forming portion 35 and the magnet roller 28, for example, as shown in FIG. 4B. In this way, the ability to deliver the developer is made higher to thereby increase the density of the toner on the photoreceptor drum 8 so that the toner density can be controlled to a desired level. When the changes in the environment, for example, higher temperature and higher humidity, cause a decease in the charge amount of the toner T and an increase in the density of the toner on the photoreceptor drum 8, the control unit 23 gives the drive command to the magnetic pole-forming portion-drive mechanism 36 to thereby control the amount of angular displacement of the magnetic pole-forming portion 35 so as to decrease the density of magnetic flux between the magnetic pole-forming portion 35 and the magnet roller 28, for example, as shown in FIG. 4A. In this way, the ability to deliver the developer is made lower to thereby decrease the density of the toner on the photoreceptor drum 8 so that the toner density can be controlled to a desired level. When the changes in the environment, for example, lower temperature and lower humidity, cause an increase in the charge amount of the toner T and a decrease in the density of the toner on the photoreceptor drum 8, the control unit 23 gives the drive command to the magnetic pole-forming portion-drive mechanism 36 to thereby control the amount of angular displacement of the magnetic pole-forming portion 35 so as to increase the density of magnetic flux between the magnetic pole-forming portion 35 and the magnet roller 28, for example, as shown in FIG. 4B. In this way, the ability to deliver the developer is made higher to thereby increase the density of the toner on the photoreceptor drum 8 so that the toner density can be controlled to a desired level.

In order to control the amount of angular displacement of the magnetic pole-forming portion 35 as described above, the control unit 23 uses a data map stored in advance. In the data map, the relation between the amount of angular displacement and the toner density is associated with the ambient environment, and the amounts of angular displacement are stored so as to be easily searched for the most suitable amount of angular displacement based on the environmental load and the toner density which are detected. When the control unit 23 uses the data map as just described, a length of time required for calculation of the amount of displacement can be shorter and the control unit 23 can control the magnetism-generating member 22 in real time based on the toner density.

As described above, the developing device 1 according to the present embodiment includes: the developing roller 17 by which the two-component developer is borne and delivered to the photoreceptor drum 8; the layer thickness-regulating member 20 for regulating the layer thickness of the developer; the magnetism-generating member 22 for generating the magnetism; and the control unit 23 for controlling the displacement of the magnetism-generating member 22. The developing roller 17 is disposed so as to be rotatable about the first axis line L1 and includes the development sleeve 27 and the magnet roller 28 which is provided inside the development sleeve and generates magnetism. The magnet roller 28 enables the developer to be borne on the surface of the development sleeve 27 and thereby delivered to the photoreceptor drum B. The magnetism-generating member 22 is disposed upstream of the layer thickness-regulating member 20 as viewed in the direction where the development sleeve 27 rotates, and the magnetism-generating member 22 moreover faces the development sleeve 27 and can be displaced. The magnetism-generating member 22 generates the magnetism which allows for the control of the layer thickness of the developer borne by the development sleeve 27. Since the control unit 23 controls the amount of displacement of the magnetism-generating member 22 relative to the development sleeve 27, the control on the amount of displacement allows for the control on the influences of the magnetism which the magnetism-generating member 22 generates toward the development sleeve 27. It is therefore possible to control an amount of developer which passes through a gap between the magnetism-generating member 22 and the development sleeve 27. The layer thickness of the developer can be thus regulated to a desired thickness without fail by the layer thickness-regulating member 22 which is located downstream of the magnetism-generating member 22 in its rotating direction. This makes it possible to control also a travel amount of the developer to the photoreceptor 8. There can be thus realized the developing device 1 having a simple configuration by which a desired amount of the developer can be delivered to the photoreceptor 8. Further, the developing device 1 as described above is provided in the image forming apparatus 2, then resulting in the image forming apparatus 2 which is capable of stably forming print images even with the temperature and humidity environment changing and with the developer deteriorating.

Further, in the embodiment, the cylindrical body 34 is driven to rotate by the drive mechanism 29 which is in common with the development sleeve 27, with the result that, even if the developer is attached to the cylindrical body 34, the rotation of the cylindrical body 34 causes the developer attached to the cylindrical body 34 to not stay thereon but be detached therefrom and attached thereto repeatedly, allowing to prevent the cylindrical body 34 from being undesirably covered with the developer. The magnetism-generating member 22 can be thus prevented from having damages due to the developer attached thereto and moreover, the maintenance can be facilitated.

Further, in the embodiment, the magnetism-generating member 22 includes the cylindrical body 34 which is disposed so as to be angularly displaceable about the second axis line L2, and the magnetic pole-forming portion 35 which is disposed inside the cylindrical body 34 and forms the magnetic poles at the plurality of positions in the circumferential direction of the cylindrical body 34. The control unit 23 controls the amount of angular displacement about the second axis line L2 of the cylindrical body 34. By controlling the amount of angular displacement, the control unit 23 can effect that, of the plurality of magnetic poles, a part which radiates the most suitable magnetism is brought to face the development sleeve 27. The magnetic force between the developing roller 17 and the layer thickness-regulating member 20 can be thus controlled. In addition, since the magnetic pole-forming portion 35 is disposed inside the cylindrical body 34, the developer can be prevented from being undesirably attached to the magnetic pole-forming portion 35. There is therefore no risk of, for example, blocking of the developer in the magnetism-generating member 22, with the result that a stable development performance can be exhibited even when the number of developments increases.

Further, in the embodiment, the magnetism-generating member 22 is disposed above the developer level 33 as viewed in the vertical direction, and positioned close to the paddle 18. By positioning the magnetism-generating member 22 close to the paddle 18, the amount of the developer to be delivered can be controlled by the magnetism-generating member 22 at a position where a large amount of the developer is supplied from the paddle 18 to the developing roller 17.

Further, in the embodiment, the length W3 of the magnetism-generating member 22 is larger than the length W4 of the developing roller 17 as viewed in the direction where the first axis line L1 extends. The property of the magnetism-generating member 22 to generate the magnetism may cause both end portions of the magnetism-generating member 22 to have lower abilities to control a travel amount of the developer compared with the ability exhibited by a middle part of the magnetism-generating member 22. The amount of the developer may be therefore different from the end portion to the middle part in the development region if the length W3 of the magnetism-generating member 22 is equal to the length W4 of the developing roller 17. In order to deal with the problem, the length W3 of the magnetism-generating member 22 is set to be longer than the length W4 of the developing roller 17 in the invention so that the amounts of the developer can be equalized between the end portion and the middle part in the development area. A difference from place to place in the amount of the developer borne on the developing roller 17 can be therefore eliminated over the entire area of the developing roller 17. As a result, the development without variations can be achieved.

Further, in the embodiment, the control unit 23 controls the amount of displacement of the magnetism-generating member 22 based on the toner density detected by the density detecting section 37 for detecting density of the toner in the image developed on the photoreceptor drum 8. An amount of the developer to be delivered can be therefore controlled based on the toner density detected in real time according to environmental changes and deterioration of the developer. As a result, the amount of the developer to be delivered can be controlled so as to be the most appropriate.

Further, in the embodiment, the magnetic force of the magnet roller 28 in the development sleeve 27 at the position where the magnet roller 28 faces the magnetism-generating member 22, is set to be larger than the magnetic force of the magnetism-generating member 22 at a position where the magnetism-generating member 22 faces the development sleeve 27. The developer borne on the developing roller 17 can be therefore prevented from being undesirably borne on the magnetism-generating member 22. In this way, the amount of the developer borne by the developing roller 17 can be prevented from being too small, with the result that the developer can be reliably delivered to the photoreceptor drum 8.

Further, in the embodiment, the developer delivered by the developing roller 17 toward the layer thickness-regulating member 20 may be subjected to magnetic attraction which acts on the developer in a direction reverse to the direction where the development sleeve 27 rotates, depending on the amount of angular displacement of the magnetic pole-forming portion 35. The magnetic attraction generated by the magnetic pole-forming portion 35 acts as a brake on the developer which moves in the direction where the development sleeve 27 rotates, thus allowing for a lower speed of the developer which collides against the layer thickness-regulating member 20 and the stagnant developer, as compared to that in a case where the magnetism-generating member 22 is not provided. This makes it possible to reduce pressure which is applied by the developer to the layer thickness-regulating member 20 and the stagnant developer when the developer collides against the layer thickness-regulating member 20 and the stagnant developer, thus allowing for a decrease in a load which is applied as counteraction by the layer thickness-regulating member 20 and the stagnant developer to the delivered developer. In the embodiment as described above, the load applied to the developer upon colliding against the layer thickness-regulating member 20 and the stagnant developer can be reduced, and the developer or, to be specific, the carrier is prevented from deteriorating, thus allowing for a decrease in deterioration of images.

Although the length of the magnetism-generating member 22 is set to be longer than the length of the developing roller 17 as viewed in the direction where the first axis line L1 extends in the embodiment, the configuration is not limited to that just mentioned, and the length of the magnetism-generating member 22 may be set to be equal to the length of the developing roller 17 as viewed in the direction where the first axis line L1 extends. This makes it possible to control the amount of the developer which passes through the gap between the magnetism-generating member 22 and the development sleeve 27, over an entire area of development region on the developing roller 17. A difference from place to place in the amount of the developer borne on the developing roller 17 can be therefore eliminated over the entire area of the developing roller 17. As a result, the development without variations can be achieved. Moreover, the developing device 1 can be downsized.

Although a diameter of the cylindrical body 34 is set to be shorter than a diameter of the development sleeve 27, the configuration is not limited to that just mentioned, and the diameter of the cylindrical body 34 may be set to be equal to the diameter of the development sleeve 27. The cylindrical body 34 and the development sleeve 27 can be therefore made in common, allowing for a decrease in cost.

Figure 6:
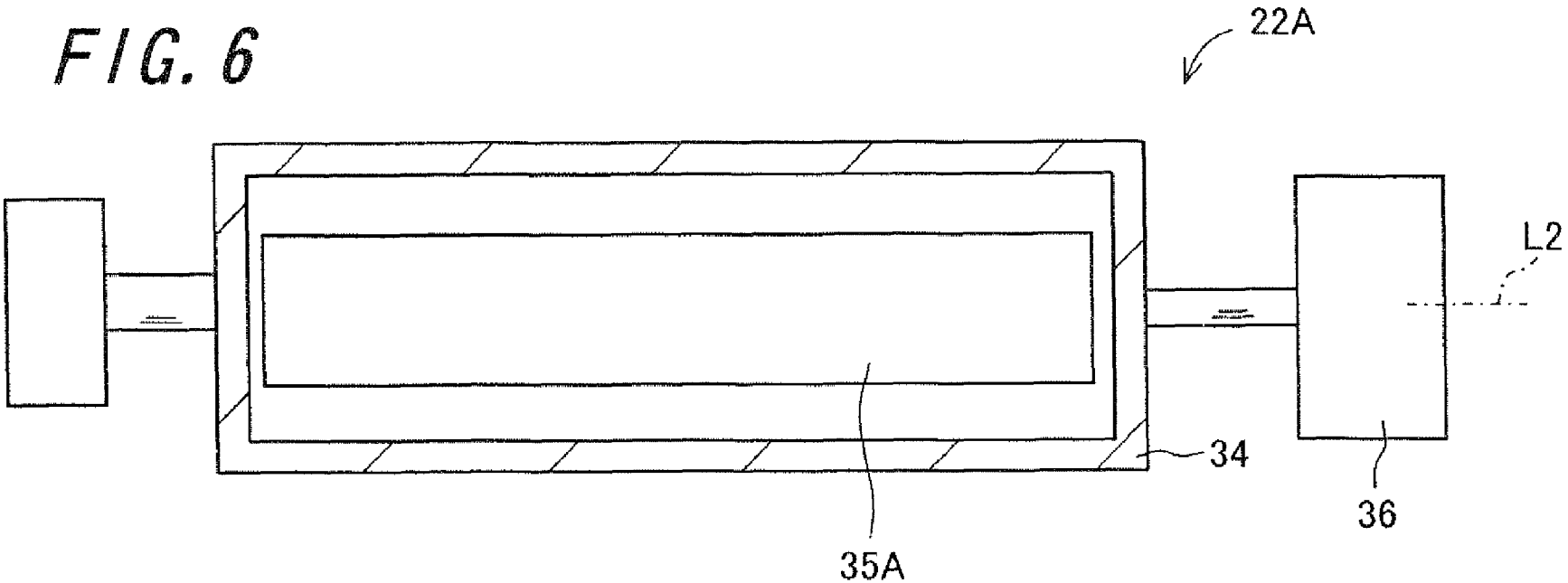
FIG. 6 is a sectional view schematically showing a magnetism-generating member.
Figure 7:
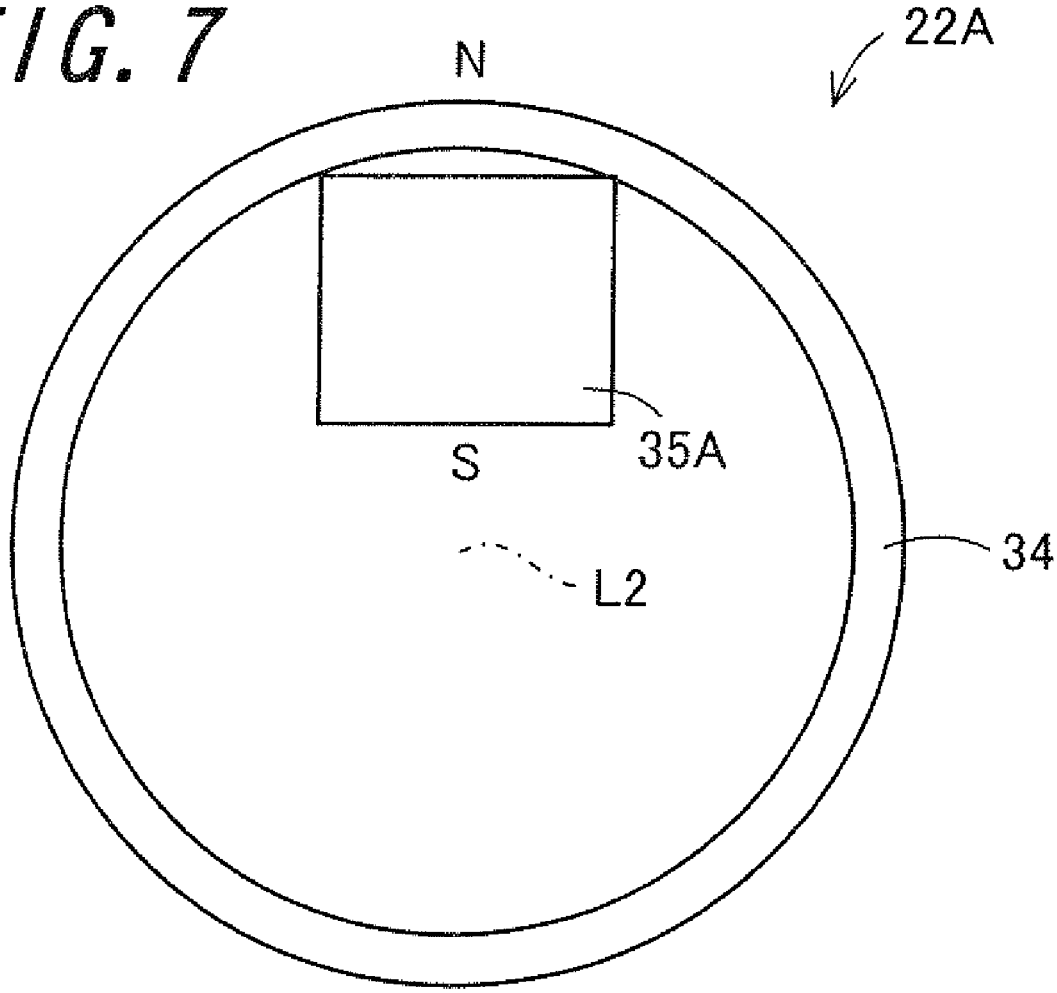
FIG. 7 is a front view schematically showing the magnetism-generating member shown in FIG. 6.

Next, there will be described the developing device 1 according to the second embodiment of the invention. FIG. 6 is a sectional view schematically showing a magnetism-generating member 22A. FIG. 7 is a front view schematically showing the magnetism-generating member 22A. In the embodiment, the cylindrical body 34 and the magnetic pole-forming portion 35A provided inside the cylindrical body 34 are integrally disposed in the magnetism-generating member 22A. Accordingly, the angular displacement of the cylindrical body 34 about the axis line L2 leads to the angular displacement of the magnetic pole-forming portion 35A about the axis line L2. The developing device 1 according to the present embodiment further includes a sliding displacement section 40 for displacing the magnetic pole-forming portion 35A relative to the development sleeve 27 in a sliding direction C which is orthogonal to the axis line of the cylindrical body 34. The magnetic pole-forming portion 35A can be displaced by the sliding displacement section 40 (refer to FIG. 8) in the sliding direction C relative to the development sleeve 27.

The magnetic pole-forming portion 35A is formed of a permanent magnet, for example. The magnetic pole-forming portion 35A is a rectangular column of which cross-sectional shape in a virtual plane perpendicular to the axis line is rectangular. The shape of the magnetic pole-forming portion 35A is not limited to that mentioned above, and may have a square cross section in the virtual plane perpendicular to the axis line, for example. The magnetic pole-forming portion 35A is disposed so that the axis line is parallel to the axis line L1 of the development sleeve 27. The magnetic pole-forming portion 35A has, over an entire length of the axis line thereof, an S-pole magnet part formed in one surface area and an N-pole magnet part formed in the other surface area as viewed in a direction perpendicular to the axis line of the magnetic pole-forming portion 35A. The magnetic pole-forming portion 35A is disposed on one side in the cylindrical body 34 as viewed in a radial direction thereof. In the magnetic pole-forming portion 35A, the S-pole magnet part is located on an inner side while the N-pole magnet part is located on an outer side as viewed in the radial direction.

In order that the cylindrical body 34 integrated with the magnetic pole-forming portion 35A constantly rotates about the axis line of the cylindrical body 34, the control unit 23 does not control the magnetic pole-forming portion-drive mechanism 36 but controls the amount of angular displacement of the magnetism-generating member 22A based on the toner density detected by the density detecting section 37. Further, on the basis of the toner density detected by the density detecting section 37, the control unit 23 controls an amount of sliding displacement of the cylindrical body 34 in a direction orthogonal to the axis line thereof to thereby change a distance of the magnetism-generating member 22A to the development sleeve 27.

As described above, the amount of the developer which is borne by the development sleeve 27 and thereby passes through the gap between the development sleeve 27 and the cylindrical body 34, is associated with the distribution of magnetic force formed by the magnet roller 28 and the magnetic pole-forming portion 35A. In the case where the N-pole magnet part of the magnet roller 28 faces an N-pole magnet part of the magnetic pole-forming portion 35A at a distance which is the shortest between the developing roller 17 and the magnetic pole-forming portion 35A, the both of the magnet parts repel each other, resulting in low density of magnetic flux between the magnetic pole-forming portion 35A and the magnet roller 28. Further, in this case, the density of magnetic flux is lower as the distance between the magnetism-generating member 22A and the developing roller 17 is shorter, so that the ability to deliver the developer becomes lower, resulting in a decrease in the amount of the developer which passes through the gap between the development sleeve 27 and the cylindrical body 34.

And then, the magnetic pole-forming portion 35 is angularly displaced about the axis line L2. In the case where the N-pole magnet part of the magnet roller 28 faces the S-pole magnet part of the magnetic pole-forming portion 35A at a distance which is the shortest between the developing roller 17 and the magnetic pole-forming portion 35A, the both of the magnet parts are pulled together, resulting in high density of magnetic flux between the magnetic pole-forming portion 35A and the magnet roller 28. Further, in this case, the density of magnetic flux is higher as the distance between the magnetism-generating member 22A and the developing roller 17 is shorter, so that the ability to deliver the developer becomes higher, resulting in an increase in the amount of the developer which passes through the gap between the development sleeve 27 and the cylindrical body 34. Accordingly, the controls on the amounts of angular displacement and sliding displacement of the magnetic pole-forming portion 35A allow for the control on the ability of the developing roller 17 to deliver the developer.

Figure 8:
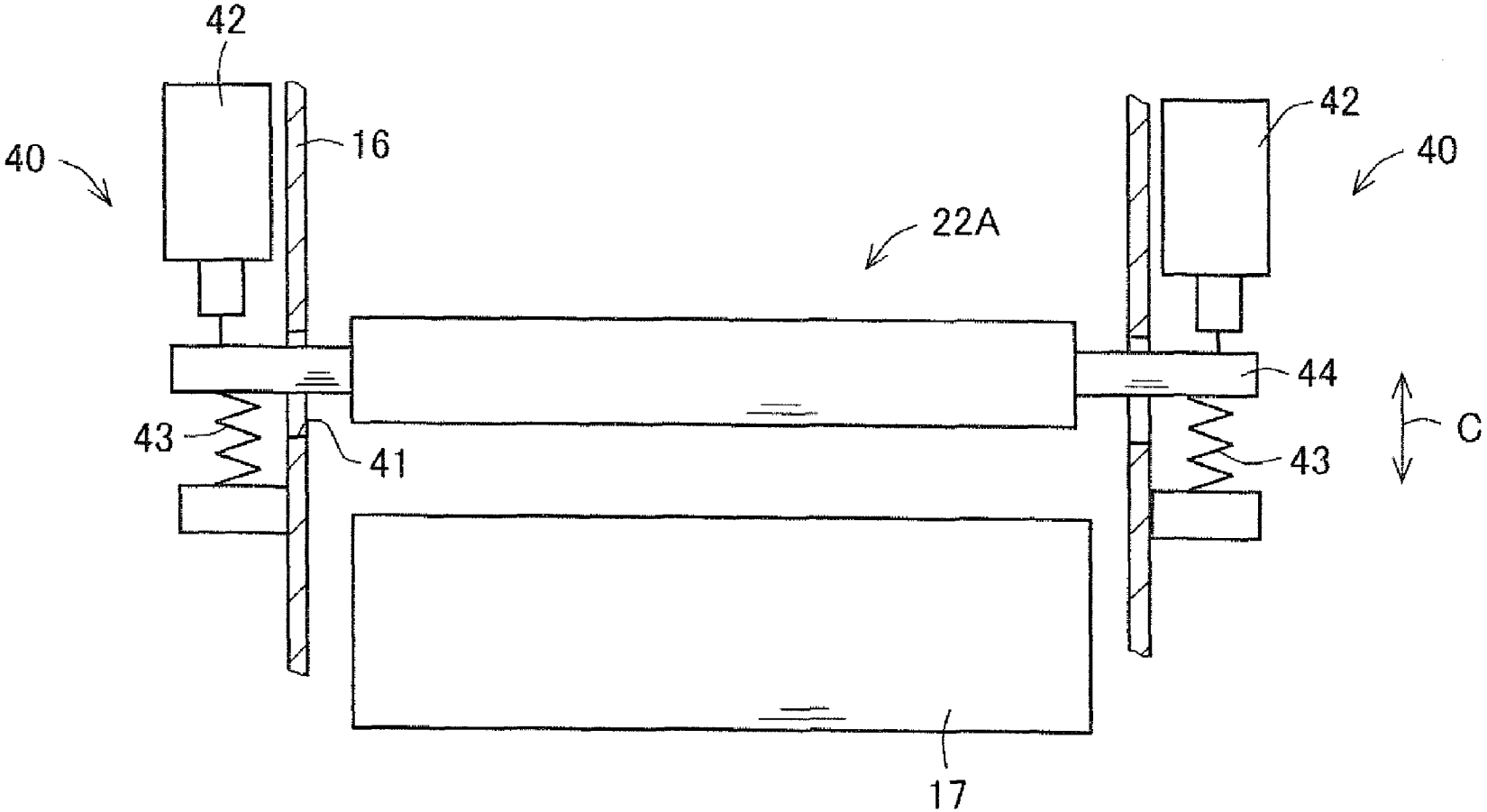
FIG. 8 is a sectional view schematically showing one example of a sliding displacement section.

FIG. 8 is a sectional view schematically showing one example of the sliding displacement section 40. The sliding displacement section 40 according to the present embodiment includes a guiding portion 41, a pressing portion 42, and a spring member 43. The guiding portion 41 guides the magnetism-generating member 22A along the sliding direction C. The pressing portion 42 presses the magnetism-generating member 22A to one side in the sliding direction C. The spring member 43 applies such spring force as to move the magnetism-generating member 22A to the other side in the sliding direction C. To the cylindrical body 34 is coaxially coupled with a shaft member 44 which transmits to the cylindrical body 34 the drive force generated by the magnetic pole-forming portion-drive mechanism 36. The guiding portion 41 guides the shaft member 44 along the sliding direction C. In the configuration according to the present embodiment, the guiding portion 41 is a slide hole which extends along the sliding direction C, and the shaft member 44 is inserted into the slide hole and guided by the slide hole so that the shaft member 44 can be displaced along the sliding direction C.

The pressing portion 42 is, for example, a solenoid, and presses both ends of the shaft member 44 as viewed in a direction of an axis line thereof, to the one side in the sliding direction C so as to be displaced only by a sliding amount which is based on a control command given by the control unit 23. The spring member 43 applies such spring force as to move the shaft member 44 to the other side in the sliding direction C, and applies such spring force as to have the shaft member 44 be constantly in contact with the pressing portion 42. Accordingly, the pressing portion 42 applies press force so as to counter the spring force of the spring member 43, thereby being capable of locating the shaft member 44 at a predetermined position. The sliding displacement section 40 is configured as described above, thereby allowing for the displacement of the shaft member 44 along the slide hole. This makes it possible to change the distance between the magnetism-generating member 22A and the developing roller 17.

Figure 9:
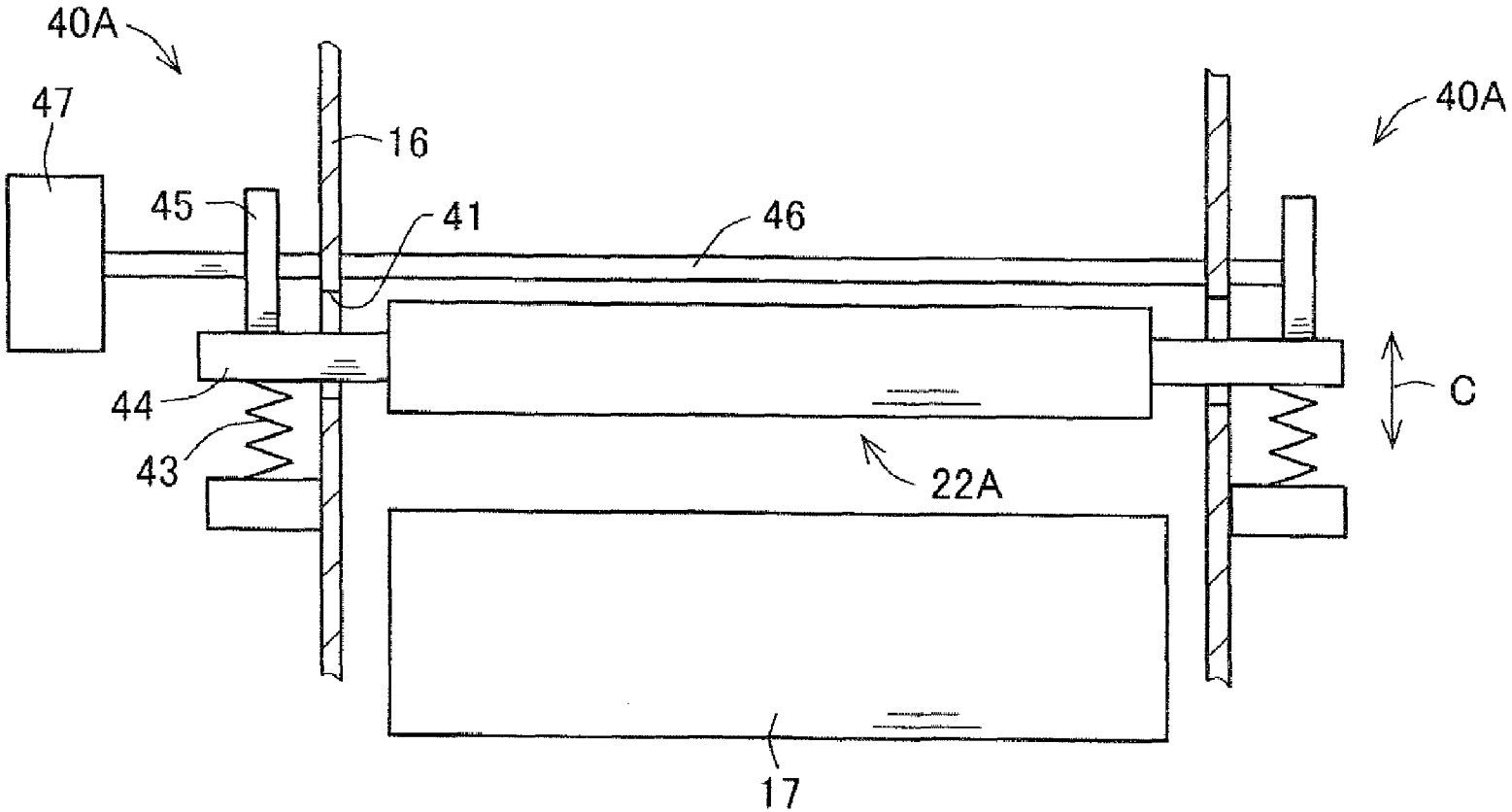
FIG. 9 is a sectional view schematically showing another example of the sliding displacement section.
Figure 10B:
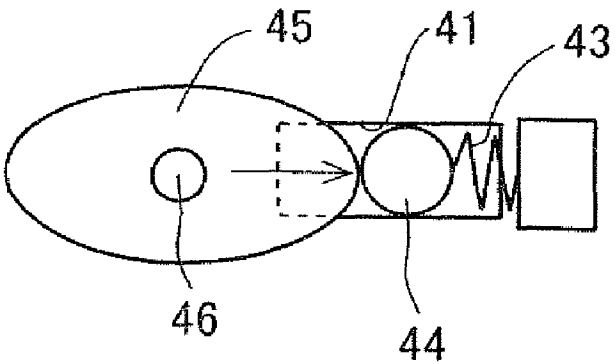
FIGS. 10A and 10B are views, each for assisting explanation of movement of the sliding displacement section.
Figure 10A:
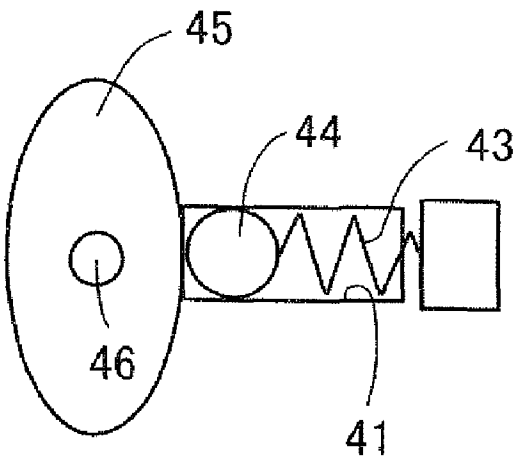

FIG. 9 is a sectional view schematically showing another example of a sliding displacement section 40A. FIGS. 10A and 10B are views, each for assisting explanation of movement of the sliding displacement section 40A. The sliding displacement section 40A includes the guiding portion 41, a cam member 45, an angular displacement portion 47, and the spring member 43. The guiding portion 41 guides the magnetism-generating member 22A along the sliding direction C. The cam member 45 is disposed in contact with the shaft member 44. The angular displacement portion 47 angularly displaces the cam member 45 about a cam shaft 46. The spring member 43 applies such spring force as to move the magnetism-generating member 22A to the other side in the sliding direction C. The guiding portion 41 guides the shaft member 44 along the sliding direction C. In the configuration according to the present embodiment, the guiding portion 41 is a slide hole which extends along the sliding direction C, and the shaft member 44 is inserted into the slide hole and guided by the slide hole so that the shaft member 44 can be displaced along the sliding direction C.

The cam members 45 are provided on both ends of the cam shaft 46 as viewed in an axis line thereof so that the cam member 45 can be angularly displaced about the axis line of the cam shaft 46 which is parallel to the axis line L2 of the cylindrical body 34. Moreover, the cam members 45 are disposed so that outer circumferential surfaces thereof respectively contact outer circumferential surfaces of the both ends of the shaft member 44 as viewed in an axis line thereof. The angular displacement portion 47 angularly displaces the cam member 45, thereby pressing the shaft member 44 so that the both ends of the shaft member 44 as viewed in an axis line thereof are displaced to the one side in the sliding direction C only by a sliding amount which is based on a control command given by the control unit 23. The spring member 43 applies such spring force as to move the shaft member 44 to the other side in the sliding direction C, and applies such spring force as to have the shaft member 44 be constantly in contact with the cam member 45. Accordingly, the cam member 45 which is located so as to extend in a direction orthogonal to the sliding direction C as shown in FIG. 10A, is angularly displaced by the angular displacement portion 47, thereby being capable of applying press force to the shaft member 44 so as to counter the spring force of the spring member 43. Consequently, the shaft member 44 can be displaced to the one side in the sliding direction C to be thereby located at a predetermined position as shown in FIG. 10B. The sliding displacement section 40A is configured as described above, thereby allowing for the displacement of the shaft member 44 along the slide hole. This makes it possible to change the distance between the magnetism-generating member 22A and the developing roller 17.

Figure 11:
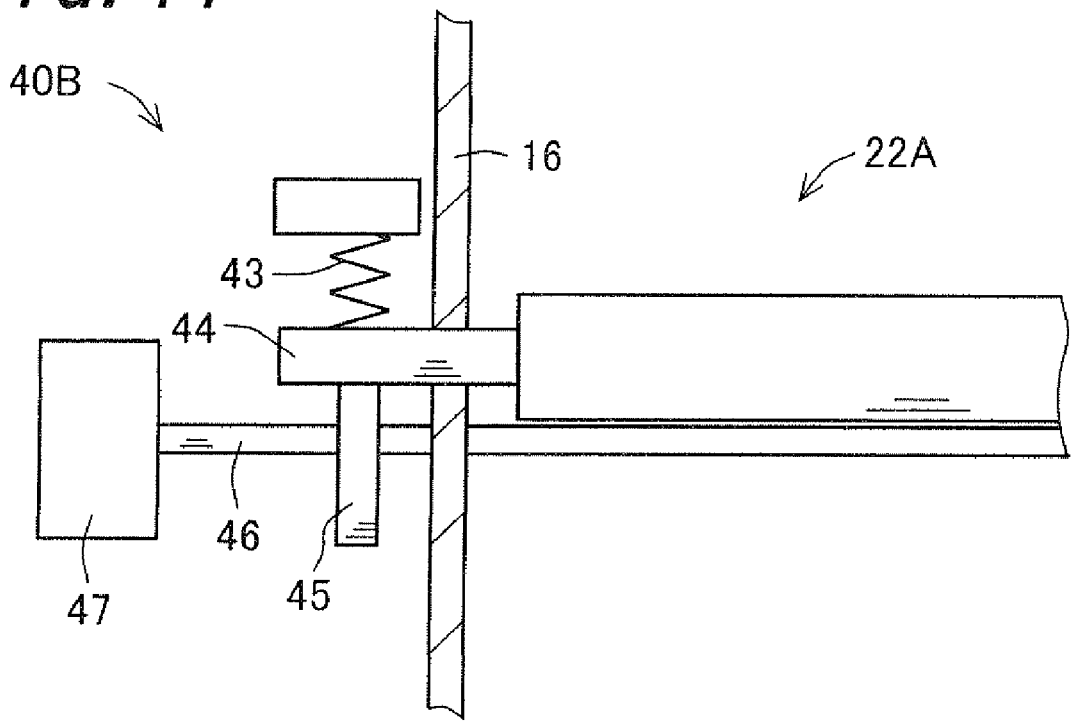
FIG. 11 is an enlarged sectional view schematically showing still another example of the sliding displacement section.
Figure 12B:
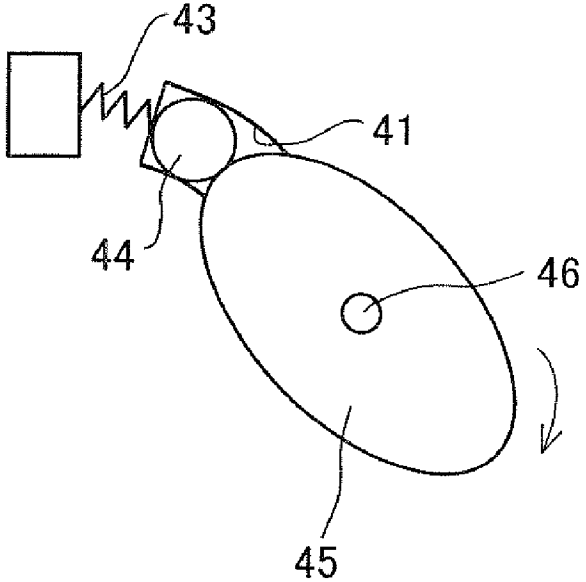
FIGS. 12A and 12B are views, each for assisting explanation of movement of the sliding displacement section.
Figure 12A:
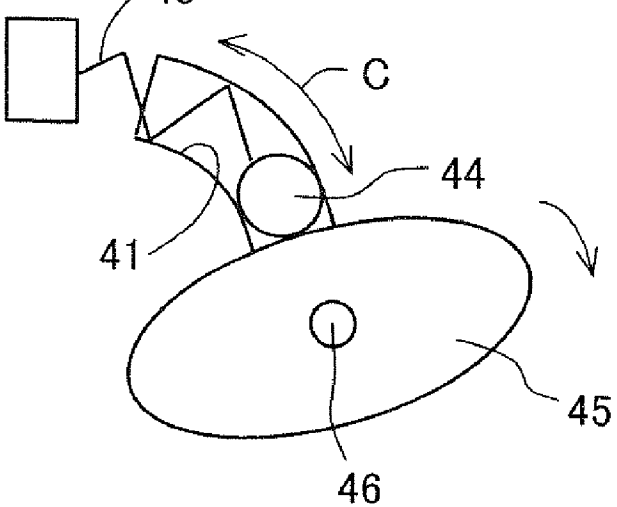

FIG. 11 is an enlarged sectional view schematically showing still another example of a sliding displacement section 40B. FIGS. 12A and 12B are views, each for assisting explanation of movement of the sliding displacement section 40B. In the sliding displacement section 40B according to the present embodiment, the sliding direction C is not a direction orthogonal to the axis line of the cylindrical body 34, but a direction along a circular arc whose rotation center is the axis line L1 of the development sleeve 27. Accordingly, the sliding displacement section 40B according to the present embodiment displaces the magnetism-generating member 22A along the outer circumference of the development sleeve 27 in a manner that a predetermined distance is maintained between the magnetism-generating member 22A and the development sleeve 27. The sliding displacement section 40B according to the embodiment includes the guiding portion 41, the cam member 45, the angular displacement portion 47, and the spring member 43. The guiding portion 41 guides the magnetism-generating member 22A along the sliding direction C. The cam member 45 is disposed in contact with the shaft member 44. The angular displacement portion 47 angularly displaces the cam member 45 about the cam shaft 46. The spring member 43 applies such spring force as to move the magnetism-generating member 22A to the other side in the sliding direction C. The guiding portion 41 guides the shaft member 44 along the sliding direction C. In the configuration according to the embodiment, the guiding portion 41 is an arch-shaped slide hole which extends along the sliding direction C, and the shaft member 44 is inserted into the slide hole and guided by the slide hole so that the shaft member 44 can be displaced along the sliding direction C.

Hence, as in the case of other examples described above, the cam member 45 which is located as shown in FIG. 12A, is angularly displaced by the angular displacement portion 47, thereby being capable of applying press force to the shaft member 44 so as to counter the spring force of the spring member 43. Consequently, the shaft member 44 can be displaced in the arch-shaped slide hole to the one side in the sliding direction C to be thereby located at a predetermined position as shown in FIG. 12B. The sliding displacement section 40B is configured as described above, thereby allowing for the displacement of the shaft member 44 along the slide hole. This makes it possible to displace the magnetism-generating member 22A along the outer circumference of the development sleeve 27 in a manner that a predetermined distance is maintained between the magnetism-generating member 22A and the development sleeve 27. Since the magnet roller 28 is composed of magnetic poles which are different from each other in a circumferential direction, the displacement of the magnetism-generating member 22A along the outer circumference of the development sleeve 27 as described above can lead to a change in the density of magnetic flux between the magnetism-generating member 22A and the developing roller 17. The above-stated effects resulting from the change of the density of magnetic flux can be thus obtained.

Figure 13:
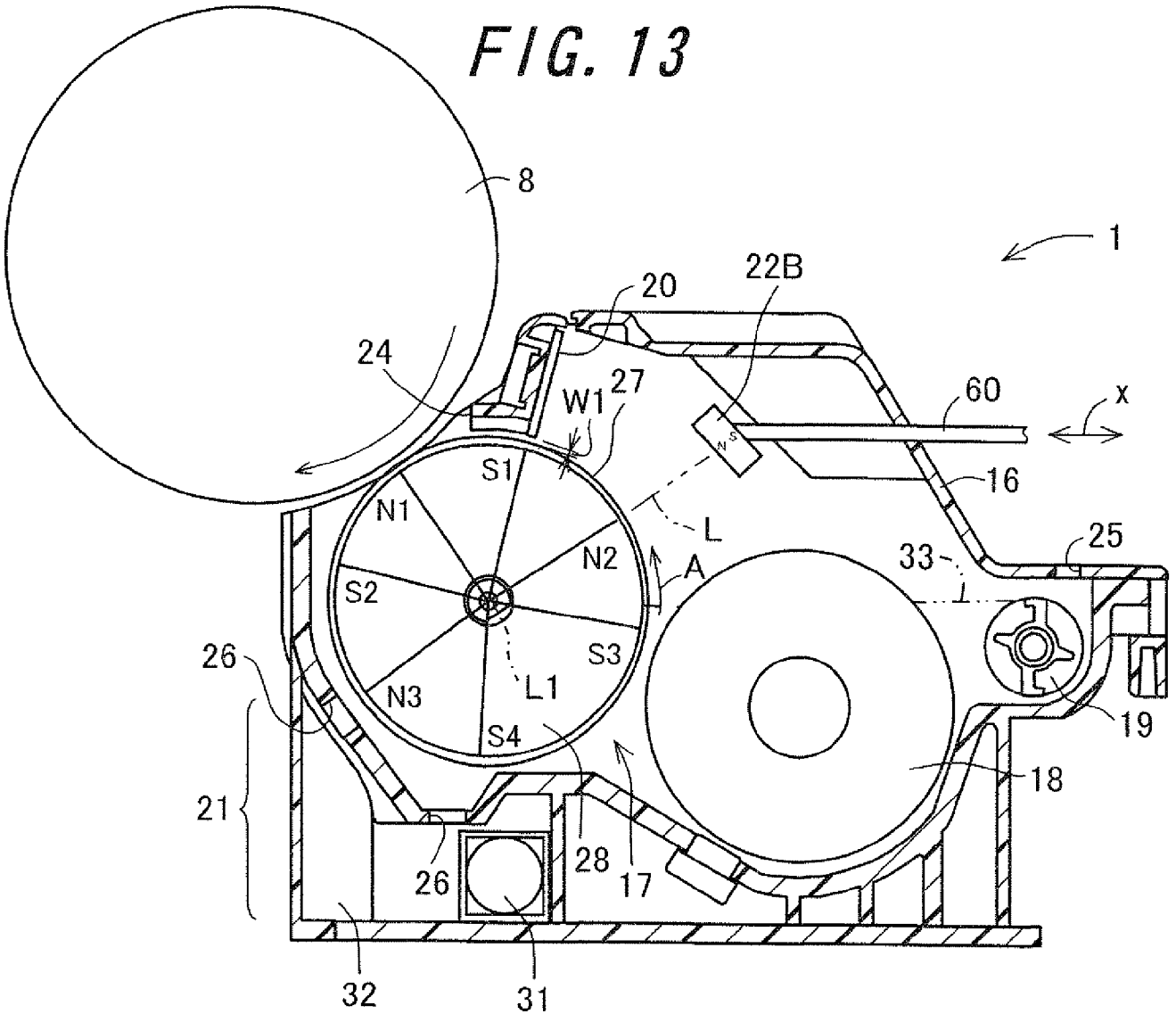
FIG. 13 is a front view schematically showing a developing device according to a third embodiment of the invention.

Next, there will be described the developing device 1 according to the third embodiment of the invention. FIG. 13 is a front view schematically showing the developing device 1 according to the third embodiment of the invention. In the present embodiment, the developing device 1 includes a magnet-moving portion 60 for displacing a magnetism-generating member 22B in a horizontal direction x relative to the development sleeve 27.

The magnetism-generating member 22B is formed of a permanent magnet, for example. The magnetism-generating member 22B is a rectangular column of which cross-sectional shape in a virtual plane perpendicular to an axis line of the magnetism-generating member 22B is rectangular. The shape of the magnetism-generating member 22B is not limited to that mentioned above, and may have a square cross section in the virtual plane perpendicular to the axis line, for example. The magnetism-generating member 22B is disposed on a line L which is an extension of a centerline of the magnet pole N2 of the magnet roller 28 so that the magnetism-generating member 22B faces the magnet roller 28. In the magnetism-generating member 22B, on a surface thereof facing the magnet roller 23, an N-pole magnet part is located while an S-pole magnet part is located on the other side surface.

The control unit controls an amount of displacement in a horizontal direction x, of the magnetism-generating member 22B relative to the development sleeve 27 based on the toner density detected by the density detecting section.

The magnet-moving portion 60 may be any member which can displace the magnetism-generating member 22B straight, such as a solenoid, a hydraulic cylinder, or a pneumatic cylinder, and by adjusting a current value, hydraulic pressure, or pneumatic pressure, the control unit controls the amount of horizontal displacement of the magnetism-generating member 22B.

The amount of the developer which is borne by the development sleeve 27 and thereby passes through the gap between the development sleeve 27 and the magnetism-generating member 22B, depends on a distribution of magnetic force formed by the magnet roller 28 and the magnetism-generating member 22B. In the case where the N-pole magnet part of the magnet roller 28 faces the N-pole magnet part of the magnetism-generating member 22B at a distance which is the shortest between the magnet roller 28 and the magnetism-generating member 22B, the both of the magnet parts repel each other, resulting in low density of magnetic flux between the magnetism-generating member 22B and the magnet roller 28. Further, in this case, the magnetism-generating member 22B is made to move horizontally, and as the distance between the magnetism-generating member 22B and the magnet roller 28 becomes shorter, the density of magnetic flux becomes lower, resulting in a decrease in the ability to deliver the developer and thus a decrease in the amount of the developer which passes through the gap between the development sleeve 27 and the magnetism-generating member 22B.

The toner to be newly supplied into the developer container 16 is set to fall down from above the agitating member to, in the embodiment, the vicinity of about midway between the paddle 18 and the agitating roller 19. The developer moving from the development sleeve 27 and the falling toner for replenishment collide with each other almost at the above-stated position so that the toner for replenishment is mixed with the developer and agitated by both of the agitating members of the paddle 18 and the agitating roller 19.

The controllability of the magnetic force changes according to how to displace the magnetism-generating member 22B. In particular, when the magnetism-generating member 22B is displaced horizontally to change the distance between the magnetism-generating member 22B and the development sleeve 27, the amount of the developer moving from the development sleeve 27 can be controlled, therefore allowing for a precise agitation control in accordance with the amount, flowability, etc., of the toner to be supplied.

For example, in the case of continuously printing with high print ratio, the amount of the toner supplied will be many times larger than that ordinarily used. Even in such a cases the toner and the developer can be agitated sufficiently. Further, under such a condition as a high-temperature and high-humidity environment where toner particles easily aggregate with each other, the agitation property can be enhanced by moving a larger amount of the developer from the development sleeve 27 than an ordinary set amount thereof.

Figure 14:
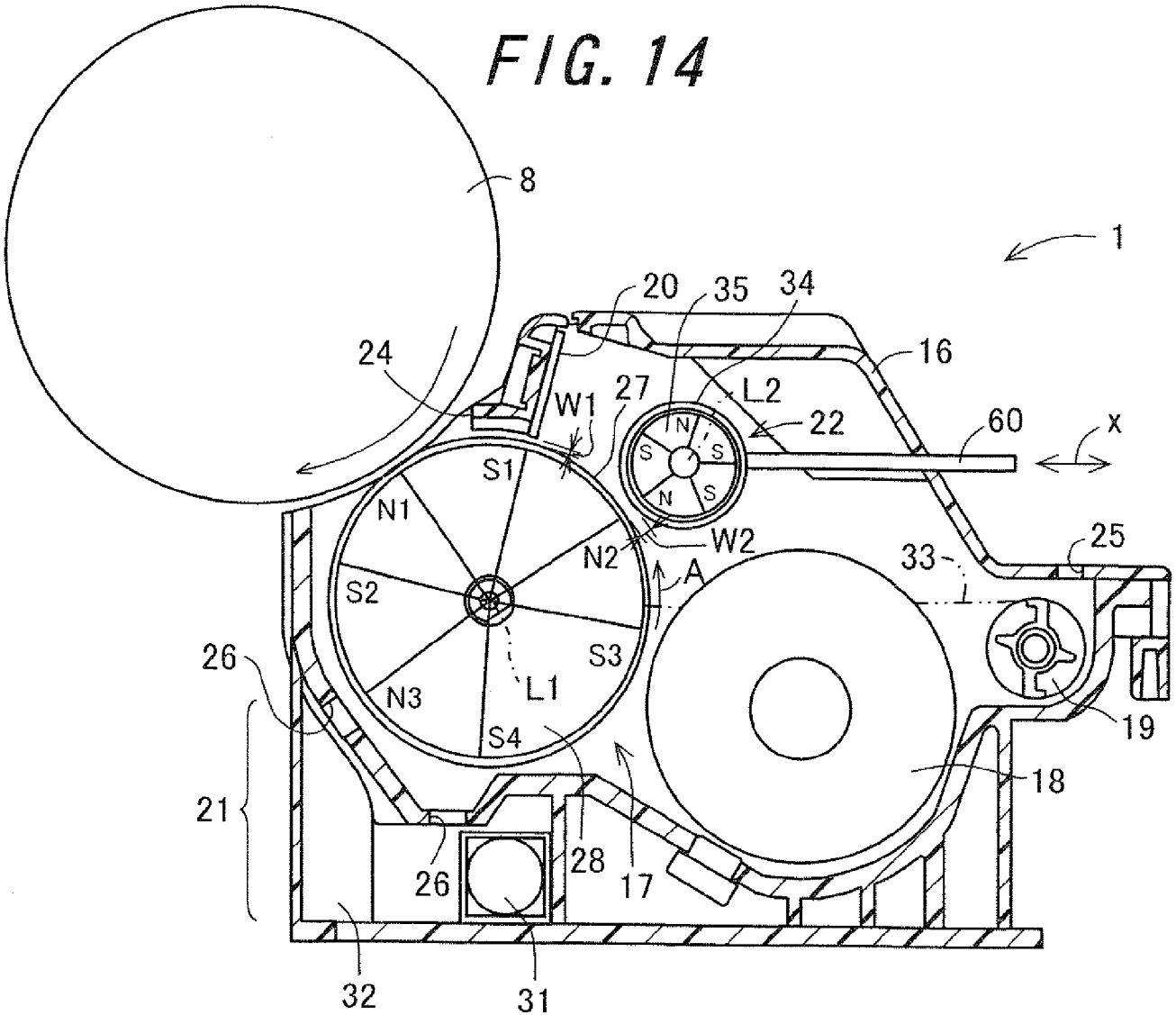
FIG. 14 is a front view schematically showing a developing device according to a fourth embodiment of the invention.

Next, there will be described the developing device 1 according to the fourth embodiment of the invention. FIG. 14 is a front view schematically showing the developing device 1 according to the fourth embodiment of the invention. The developing device 1 according to the present embodiment has a similar configuration to that of the developing device 1 according to the first embodiment of the invention shown in FIG. 1. Only the difference between those configurations is that the developing device 1 according to the present embodiment includes a magnet-moving portion 60 for displacing the magnetism-generating member 22 in the horizontal direction x relative to the development sleeve 27.

In the embodiment, the magnetic pole-forming portion 35 is angularly displaced about the axis line of the cylindrical body 34 when the cylindrical body 34 is angularly displaced about the axis line. The magnetism-generating member 22 is displaced in the horizontal direction x by the magnet-moving portion 60 relative to the development sleeve 27.

The magnetic pole-forming portion 35 is formed of a permanent magnet, for example. The magnetic pole-forming portion 35 is a rectangular column of which cross-sectional shape in a virtual plane perpendicular to an axis line of the magnetic pole-forming portion 35 is rectangular. The shape of the magnetic pole-forming portion 35 is not limited to that mentioned above, and may have a square cross section in the virtual plane perpendicular to the axis line, for example. The magnetic pole-forming portion 35 is disposed in parallel with the axis line of the development sleeve 27. The magnetic pole-forming portion 35 has, over an entire length of the axis line thereof, an S-pole magnet part formed in one surface area and an N-pole magnet part formed in the other surface area as viewed in a direction perpendicular to the axis line of the magnetic pole-forming portion 35. The magnetic pole-forming portion 35 is disposed on one side in the cylindrical body 34 as viewed in a radial direction thereof. In the magnetic pole-forming portion 35, the S-pole magnet part is located on an inner side while the N-pole magnet part is located on an outer side as viewed in the radial direction.

The magnet-moving portion 60 may be any member which can displace the magnetism-generating member 22B straight, such as a solenoid, a hydraulic cylinder, or a pneumatic cylinder, and by adjusting a current value, hydraulic pressure, or pneumatic pressure, the control unit controls the amount of horizontal displacement of the magnetism-generating member 22B.

In order that the cylindrical body 34 integrated with the magnetic pole-forming portion 35 constantly rotates about the axis line of the cylindrical body 34, the control unit 23 does not control the magnetic pole-forming portion-drive mechanism 36 but controls the amount of angular displacement of the magnetism-generating member 22 based on the toner density detected by the density detecting section. Further, on the basis of the toner density detected by the density detecting section, the control unit controls the magnet-moving portion 60 and thereby controls the amount of displacement in the horizontal direction x, of the magnetism-generating member 22 relative to the development sleeve 27.

As described above, the amount of the developer which is borne by the development sleeve 27 and thereby passes through the gap between the development sleeve 27 and the cylindrical body 34, depends on the distribution of magnetic force formed by the magnet roller 28 and the magnetic pole-forming portion 35. In the case where the N-pole magnet part of the magnet roller 28 faces the N-pole magnet part of the magnetism-generating member 22 at a distance which is the shortest between the magnet roller 28 and the magnetism-generating member 22, the both of the magnet parts repel each other, resulting in low density of magnetic flux between the magnetism-generating member 22 and the magnet roller 28. Further, in this case, the magnetism-generating member 22 is made to move horizontally, and as the distance between the magnetism-generating member 22 and the magnet roller 28 becomes shorter, the density of magnetic flux becomes lower, resulting in a decrease in the ability to deliver the developer and thus a decrease in the amount of the developer which passes through the gap between the development sleeve 27 and the magnetism-generating member 22.

And then, the magnetic pole-forming portion 35 is angularly displaced about the axis line. In the case where the N-pole magnet part of the magnet roller 28 faces the S-pole magnet part of the magnetic pole-forming portion 35 at a distance which is the shortest between the magnet roller 28 and the magnetic pole-forming portion 35, the both of the magnet parts are pulled together, resulting in high density of magnetic flux between the magnetic pole-forming portion 35 and the magnet roller 28. Further, in this case, as the distance between the magnetism-generating member 22 and the magnet roller 28 becomes shorter, the density of magnetic flux becomes higher, resulting in an increase in the ability to deliver the developer and thus an increase in the amount of the developer which passes through the gap between the development sleeve 27 and the magnetic pole-forming portion 35. Accordingly, the controls on the amounts of angular displacement and horizontal displacement of the magnetic pole-forming portion 35 allow for precise control on the ability of the developing roller 17 to deliver the developer.

The toner to be newly supplied into the developer container 16 is set to fall down from above the agitating member to, in the embodiment, the vicinity of about midway between the paddle 18 and the agitating roller 19. The developer moving from the development sleeve 27 and the falling toner for replenishment collide with each other almost at the above-stated position so that the toner for replenishment is mixed with the developer and agitated by both of the agitating members of the paddle 18 and the agitating roller 19.

The controllability of the magnetic force changes according to how to displace the magnetism-generating member 22. In particular, when the magnetism-generating member 22 is rotated to move in the horizontal direction x, the amount of the developer moving from the development sleeve 27 and the position where the developer collides with the toner for replenishment can be finely adjusted and controlled in accordance with the properties, usage environment, etc., of the developer, thus resulting in the most suitable agitating performance.

Next, there will be described the developing device 1 according to the fifth embodiment of the invention. FIGS. 15A to 15D are enlarged front views, each showing the surface of the cylindrical body 34 and the surface of the development sleeve 27. In the present embodiment, it is characterized in that surface roughness of the magnetism-generating member 22 is different from surface roughness of the development sleeve 27.

Figure 15A:
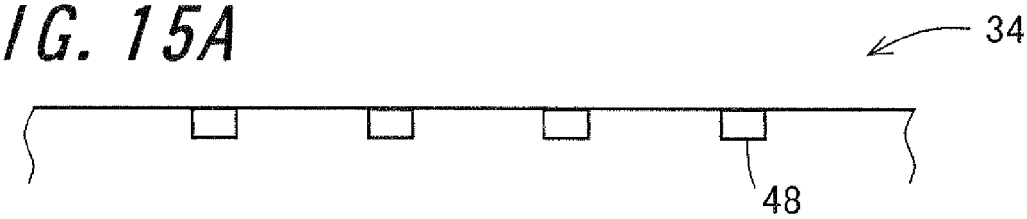
FIGS. 15A to 15D are enlarged front views, each showing a surface of a cylindrical body and a surface of a development sleeve.
Figure 15B:
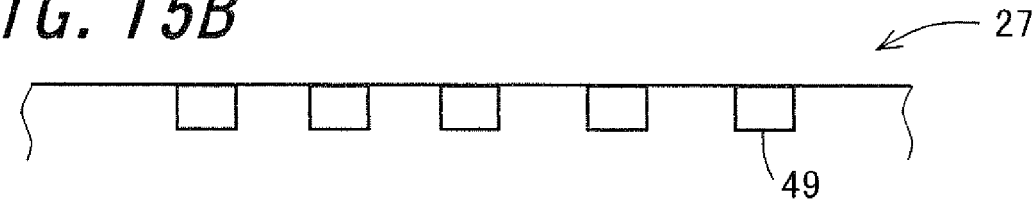

FIG. 15A is a view showing the surface of the cylindrical body 34. As shown in FIG. 15A, for example, the surface of the cylindrical body 34 includes a plurality of rectangular grooves 48 which extend along the direction of axis line of the cylindrical body 34. A depth of the groove 48 of the cylindrical body 34 is 1 mm, for example, and an interval between the grooves 48 is 1 mm, for example. FIG. 15B is a view showing the surface of the development sleeve 27. As shown in FIG. 15B, for example, the surface of the development sleeve 27 includes a plurality of rectangular grooves 49 which extend along the direction of axis line of the development sleeve 27. A depth of the groove 49 of the development sleeve 27 is 3 mm, for example, and an interval between the grooves 49 is 3 mm, for example. As just described, the configuration is made so that the surface roughness of the cylindrical body 34 is different from the surface roughness of the development sleeve 27. Further, the configuration is not limited to those as shown in FIG. 15A and FIG. 15B in each of which the surface roughness of the cylindrical body 34 is smaller than the surface roughness of the development sleeve 27, and the surface roughness of the cylindrical body 34 may be larger than the surface roughness of the development sleeve 27.

Figure 15C:
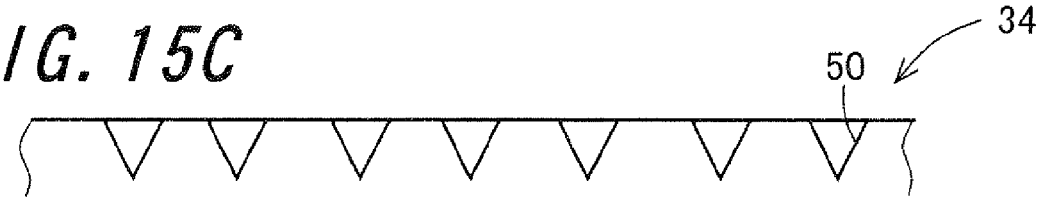
Figure 15D:
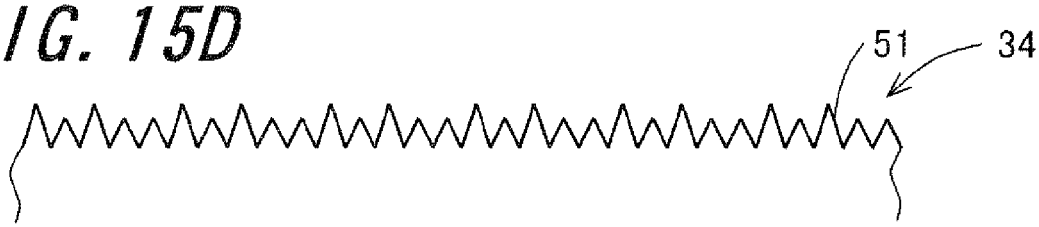

In addition, a shape of the groove 48 and a shape of the groove 49 are not limited to rectangles as shown FIGS. 15A and 15B. V-shaped grooves 50 as shown in FIG. 15C are applicable. Further, the surface may be subjected to a sandblasting process so as to have surface roughness Rz of a few μm or more and a few hundred μm or less, resulting in grooves 51 as shown in FIG. 15D. The rectangular grooves 48 and 49 and the V-shaped grooves 50 can be formed by previously providing molds of such shapes which are used in molding during the drawing process. Note that the sandblasting process is a method of forming grooves in a surface by spraying the surface with abrasive such as glass beads.

By changing the shape, size, etc. of the groove and the interval between the grooves as stated above, the abilities of the development sleeve 27 and cylindrical body 34 to deliver the developer can be changed freely. The amount of delivered developer can be evaluated by measuring a weight of the developer per unit area after the developing roller 17 has been made to rotate by, for example, an external slipping machine, under a predetermined condition, e.g. at a rate of 400 rpm for three minutes.

As described above, the surface roughness of the magnetism-generating member 22 is different from the surface roughness of the development sleeve 27 in the embodiment. By setting the surface roughness of the magnetism-generating member 22 to be different from the surface roughness of the development sleeve 27 as mentioned above, an amount of moving developer borne on the surface of the magnetism-generating member 22 can be made different from an amount of moving developer borne on the surface of the development sleeve 27. Therefore, for example, when the surface of the development sleeve 27 is rougher than the surface of the magnetism-generating member 22, a larger amount of the developer can be delivered to the development sleeve 27, allowing for setting the development sleeve 27 to exhibit higher ability to deliver the developer than that of the magnetism-generating member 22. In this way, the amount of the developer delivered by the developing roller 17 can be set at a desired amount.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device which develops an electrostatic latent image formed on an image bearing member, with use of two-component developer, the developing device comprising:

a developer bearing member capable of rotating around a predetermined first axis line, the developer bearing member having a development sleeve by which the two-component developer is borne and delivered to the image bearing member, and a magnet roller for generating magnetism provided in the development sleeve;

a layer thickness-regulating member for regulating a layer thickness of the two-component developer borne on the development sleeve, the layer thickness-regulating member facing the development sleeve;

a magnetism-generating member for generating magnetism, which is disposed upstream of the layer thickness-regulating member in a direction where the development sleeve rotates, the magnetism-generating member facing the development sleeve and being displaceable; and a control unit for controlling an amount of displacement of the magnetism-generating member relative to the development sleeve.

2. The developing device of claim 1, wherein the magnetism-generating member is capable of being displaced at least horizontally, and the control unit controls an amount of horizontal displacement of the magnetism-generating member.

3. The developing device of claim 1, wherein the magnetism-generating member comprises:

a cylindrical body having a cylindrical shape which is capable of being angularly displaced around a predetermined second axis line; and a magnetic pole-forming portion for forming magnetic poles at a plurality of positions in a circumferential direction of the cylindrical body, which magnetic pole-forming portion is located inside the cylindrical body, and the control unit controls an amount of angular displacement of the cylindrical body around the second axis line.

4. The developing device of claim 1, wherein a length of the magnetism-generating member is equal to a length of the developer bearing member as viewed in a direction where the first axis line extends.

5. The developing device of claim 1, wherein a length of the magnetism-generating member is longer than a length of the developer bearing member as viewed in a direction where the first axis line extends.

6. The developing device of claim 1, wherein the control unit controls the amount of displacement of the magnetism-generating member based on toner density detected by a density detecting section for detecting density of a toner in an image developed on the image hearing member.

7. The developing device of claim 1, wherein surface roughness of the magnetism-generating member is different from surface roughness of the development sleeve.

8. The developing device of claim 3, wherein a diameter of the cylindrical body is smaller than a diameter of the development sleeve.

9. The developing device of claim 3, wherein a diameter of the cylindrical body is equal to a diameter of the development sleeve.

10. The developing device of claim 1, wherein magnetic force of the magnet roller in the development sleeve which force is positioned opposite to the magnetism-generating member, is set to be larger than magnetic force of the magnetism-generating member which force is positioned opposite to the development sleeve.

11. An image forming apparatus comprising the developing device of claim 1.

* * * * *